US007565102B2

(12) United States Patent
Suzuki

(10) Patent No.: US 7,565,102 B2
(45) Date of Patent: Jul. 21, 2009

(54) IMAGE HEATING APPARATUS WITH ELECTRICAL CONNECTION BETWEEN CONTACT MEMBER AND ELECTROCONDUCTIVE LAYER OF IMAGE HEATING MEMBER

(75) Inventor: Hitoshi Suzuki, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 355 days.

(21) Appl. No.: 11/406,332

(22) Filed: Apr. 19, 2006

(65) Prior Publication Data

US 2006/0245797 A1 Nov. 2, 2006

(30) Foreign Application Priority Data

Apr. 28, 2005 (JP) ..... 2005-133237

(51) Int. Cl.
*G03G 15/20* (2006.01)

(52) U.S. Cl. ..... 399/328; 399/330; 399/334

(58) Field of Classification Search ..... 399/328, 399/330, 334

See application file for complete search history.

(56) References Cited

U.S. PATENT DOCUMENTS

| | | | | |
|---|---|---|---|---|
| 5,464,964 | A | 11/1995 | Okuda et al. | 219/497 |
| 5,534,987 | A | 7/1996 | Ohtsuka et al. | 355/285 |
| 5,747,774 | A | 5/1998 | Suzuki et al. | 219/216 |
| 5,994,671 | A | 11/1999 | Suzuki et al. | 219/216 |
| 6,713,734 | B2 | 3/2004 | Suzuki | 219/619 |
| 6,969,833 | B2 | 11/2005 | Suzuki | 219/619 |
| 7,034,261 | B2 | 4/2006 | Suzuki | 219/619 |
| 7,038,178 | B2 | 5/2006 | Suzuki | 219/619 |
| 2004/0253027 | A1 * | 12/2004 | Kato et al. | 399/328 |
| 2005/0173415 | A1 | 8/2005 | Yamamoto et al. | 219/619 |
| 2005/0180787 | A1 | 8/2005 | Nami et al. | 399/328 |
| 2005/0211700 | A1 | 9/2005 | Kondo et al. | 219/619 |
| 2006/0081614 | A1 | 4/2006 | Nami et al. | 219/619 |
| 2006/0086719 | A1 | 4/2006 | Suzuki et al. | 219/619 |
| 2006/0086720 | A1 | 4/2006 | Nakase et al. | 219/619 |
| 2006/0086724 | A1 | 4/2006 | Yamamoto et al. | 219/619 |
| 2006/0086726 | A1 | 4/2006 | Yamamoto et al. | 219/619 |
| 2006/0086730 | A1 | 4/2006 | Kondo et al. | 219/645 |
| 2006/0088327 | A1 | 4/2006 | Nakase et al. | 399/69 |
| 2006/0088328 | A1 | 4/2006 | Yoshimura et al. | 399/69 |

FOREIGN PATENT DOCUMENTS

| | | |
|---|---|---|
| JP | 10-74009 | 3/1998 |

* cited by examiner

*Primary Examiner*—David M Gray
*Assistant Examiner*—Ryan D Walsh
(74) *Attorney, Agent, or Firm*—Fitzpatrick, Cella, Harper & Scinto

(57) ABSTRACT

An image heating apparatus includes magnetic flux generating means for generating a magnetic flux; an image heating member for generating heat by eddy current produced by the magnetic flux generated by the magnetic flux generating means and for heating an image on a recording material fed thereto; a diverting member for diverting the eddy current produced in the image heating member by contacting at least a part, with respect to a widthwise direction perpendicular to a feeding direction of the recording material, of the image heating member to establish electrical connection with the image heating member; and driving means for contacting and spacing the diverting member relative to the image heating member.

12 Claims, 16 Drawing Sheets

IMAGE HEATING APPARATUS WITH ELECTRICAL CONNECTION BETWEEN CONTACT MEMBER AND ELECTROCONDUCTIVE LAYER OF IMAGE HEATING MEMBER

FIELD OF THE INVENTION AND RELATED ART

The present invention relates to an image heating apparatus which heats an image on recording medium, with the use of an inductive heating method. More specifically, it relates to an image heating apparatus which is excellent as a thermal fixing apparatus mounted in such an image forming apparatus as a copying machine or a printer, which forms an image using an electrophotographic image forming method or the like.

A heating apparatus of the heat roller type, which typically employs a halogen lamp as a heat source, has long been employed as a thermal fixing apparatus mounted in a printer, a copying machine, etc. In recent years, however, various fixing apparatuses which employ an inductive heating method have been realized as one of the answers to the recent trend of reducing office automation equipment in energy consumption, and some of them have been put to practical use, in place of a fixing apparatus of the heat roller type. An inductive heating apparatus can achieve both the object of reducing an image heating apparatus in energy consumption, and the object of reducing an image heating apparatus in the length of startup time.

A fixing apparatus employing an inductive heating method is made up of a magnetic flux generating means, and a member (inductive heating member) in which heat is generated through electromagnetic induction by the function of the magnetic flux generated by the magnetic flux generating means. In a fixing operation, a piece of recording medium as an object to heated is introduced into the heating portion of the fixing apparatus, and conveyed through the heating portion. While the recording medium is conveyed through the heating portion, the unfixed image on the recording medium is thermally fixed to the recording medium by the heat from the inductive heating member.

From the standpoint of reducing a fixing apparatus of the induction type in energy consumption as well as length of startup time, the inductive heating member should be reduced in thickness to reduce it in thermal capacity. Further, from the standpoint of reducing the inductive heating member in thermal capacity without reducing it in strength, it is formed of iron, nickel, SUS, or the like. However, this design suffers from the following problem. That is, as a substantial number of small sheets of recording paper, that is, sheets of recording paper which are narrower in track width than the largest sheet of recording paper that can be conveyed through a fixing apparatus (recording medium of full size), in terms of the direction perpendicular to the direction in which a recording medium is to be conveyed through the fixing apparatus, the portions of the heating member, which are outside the track of the small sheet of recording paper, excessively increase in temperature.

In the past, as one of the measures for preventing a fixing apparatus employing an inductive heating method from excessively increasing in temperature across the portions of its heating member, which are outside the sheet track, a magnetic flux blocking means has been employed. More specifically, according to Japanese Laid-open Patent Application 10-74009, that is, one of the various Japanese patent applications which propose the abovementioned measures, a means for adjusting a magnetic flux, more specifically, a magnetic flux blocking means, is disposed within a magnetic circuit to adjust in distribution the magnetic flux generated from the magnetic flux generating means.

With the employment of the above described structural arrangement, it was possible to change the magnetic flux in its distribution across a fixation roller, in terms of the lengthwise direction of the fixation roller. Therefore, it was possible to adjust the fixation roller in the distribution of the amount by which Joule heat is generated in the wall of a fixation roller by eddy current, in terms of the lengthwise direction of the fixation roller. In other words, it was possible to adjust the magnetic flux in the distribution of its density in the lengthwise direction of the fixation roller in order to adjust the fixation roller in the distribution of the amount by which Joule heat is generated in the fixation roller, in terms of the lengthwise direction of the fixation roller so that the temperature distribution of the fixation roller becomes optimal for the size of the recording medium being used for image formation.

Further, in the case of a structural arrangement in which the magnetic flux adjusting member is inserted into the abovementioned magnetic flux circuit from outside the magnetic circuit, in the direction parallel to the lengthwise direction of the fixation roller, a fixing apparatus has to be increased in size in the lengthwise direction of the fixation roller, by the amount equal to the size of the space into which the magnetic flux adjusting member is to be retracted. Therefore, in order to adjust the distribution of magnetic flux density in terms of the lengthwise direction of the fixation roller without increasing the fixing apparatus in size, a fixing apparatus is structured so that the magnetic flux adjusting member can be rotated in the direction parallel to the circumferential direction of the fixation roller, between a position in which it allows the magnetic flux to heat the portion of the fixation roller, which corresponds in position to the magnetic flux adjusting member, and a position in which it does not allow the magnetic flux to heat the portion of the fixation roller, which corresponds in position to the magnetic flux adjusting member.

However, in the case of the structural arrangement in which the magnetic flux adjusting member can be rotated in the circumferential direction of a fixation roller to adjust the distribution of the magnetic flux density in terms of the lengthwise direction of the fixation roller, the coil and core of the magnetic flux generating means must be disposed so that a fixation roller is heated across the portion in a specific space in terms of the circumferential direction of the fixation roller. Such a requirement restricts the magnetic circuit in structure. Moreover, in the case of the method which partially blocks the magnetic flux, the portions of the fixation roller, which are shielded from the magnetic flux by the magnetic flux blocking member, rapidly decreases in temperature, requiring therefore the magnetic flux adjusting member to be frequently shuttled between the magnetic flux blocking position and the retreat; it increases the number of times the magnetic flux adjusting member must be driven.

SUMMARY OF THE INVENTION

Thus, the primary object of the present invention is to provide an inductive image heating apparatus, the image heating member of which can be adjusted in the temperature distribution in terms of the direction perpendicular to the recording medium conveyance direction, without partially blocking the magnetic flux.

Another object of the present invention is to provide an image heating apparatus, the image heating member of which can be adjusted in the temperature distribution in terms of the direction perpendicular to the recording medium conveyance direction, by partially diverting the eddy current which is induced in the image heating member.

According to an aspect of the present invention, there is provided an image heating apparatus comprising magnetic flux generating means for generating a magnetic flux; an image heating member for generating heat by eddy current produced by the magnetic flux generated by said magnetic flux generating means and for heating an image on a recording material fed thereto; a diverting member for diverting the eddy current produced in said image heating member by contacting at least a part, with respect to a widthwise direction perpendicular to a feeding direction of the recording material, of said image heating member to establish electrical connection with said image heating member; and driving means for contacting and spacing said diverting member relative to said image heating member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Example of Image Forming Apparatus

Figure 2:
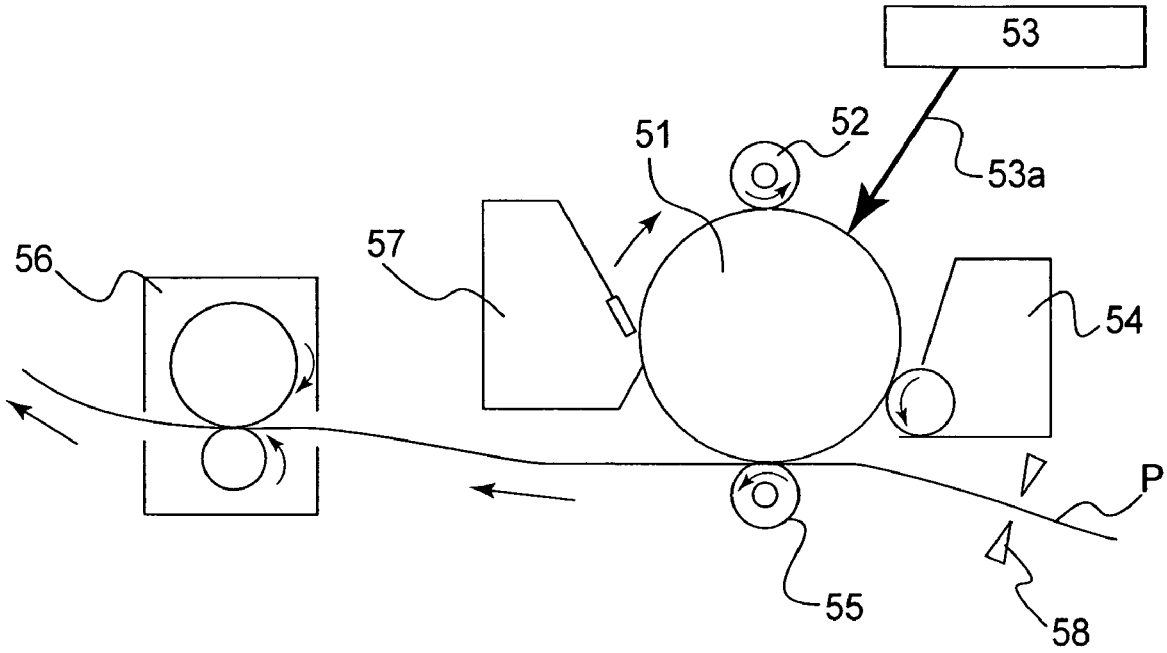
FIG. 2 is a schematic drawing of the image forming apparatus in the first embodiment of the present invention, showing the general structure thereof.

FIG. 2 is a schematic drawing of the image forming apparatus in this embodiment, showing the general structure thereof. The image forming apparatus in this embodiment is a laser beam printer of the transfer type, which employs an electrophotographic process.

Designated by a referential symbol 51 is a photosensitive drum. The photosensitive drum 51 is made up of an electrically conductive cylindrical substrate formed of aluminum, nickel, or the like, and a photosensitive layer formed of a photosensitive substance such as OPC, amorphous selenium, amorphous silicon, or the like, around the peripheral surface of the cylindrical substrate.

The photosensitive drum 51 is rotationally driven in the clockwise direction indicated by an arrow mark at a preset peripheral velocity. As the photosensitive drum 51 is rotated, first, its peripheral surface is uniformly charged by a charge roller 52 as a charging apparatus to preset polarity and potential level.

Next, the uniformly charged peripheral surface of the photosensitive drum 51 is scanned (exposed) by a beam 53*a* of laser light projected from a laser scanner 53 while being turned on or off in accordance with image formation data. As a result, an electrostatic latent image is formed on the peripheral surface of the photosensitive drum 51.

This electrostatic latent image is developed by a developing apparatus 54 into a visible image, that is, an image formed of toner (which hereinafter will be referred to as toner image). As the method for developing the latent image, the jumping developing method, two-component developing method, FEED developing method, or the like may be used. The above described exposing process is likely to be used in combination with a reversal developing method.

The toner image, that is, the visualized latent image, is transferred by a transfer roller 55 as a transferring apparatus from the peripheral surface of the photosensitive drum 51 onto a recording medium P, for example, a sheet of recording paper, OHP, etc., which is delivered with a preset timing.

As for the above described delivery of the recording medium P, the leading edge of the recording medium P is detected by a sensor 58, and the timing of the delivery of the recording medium P is set so that as the recording medium P is delivered, the leading edge of the portion of the peripheral surface of the photosensitive drum 51 across which a toner image is formed, and the portion of the recording medium P, which will be the leading edge of the toner image after the transfer of the toner image from the photosensitive drum 51 onto the recording medium P, simultaneously arrive at the image transfer station. After being delivered with the preset timing to the transfer station, the recording medium P is conveyed through the transfer station while remaining pinched between the photosensitive drum 51 and transfer roller 55, and while the recording medium P is conveyed through the transfer station, the toner image on the photosensitive drum 51 is transferred onto the recording medium P as if it were rolled out of the photosensitive drum 51. After the transfer of the toner image onto the recording medium P, the recording medium P is separated from the peripheral surface of the photosensitive drum 51, and conveyed to a fixing apparatus 6 as a heating apparatus. Then, the toner image on the recording medium P is thermally fixed as a permanent image to the recording medium P.

Meanwhile, the portion of the peripheral surface of the photosensitive drum 51, from which the recording medium P has been separated, is cleaned by a cleaning apparatus 57; the residual toner particles, that is, the toner particles remaining on the peripheral surface of the photosensitive drum 51 after the image transfer, are removed by the cleaning apparatus 57. Then, the cleaned portion of the peripheral surface of the photosensitive drum 51 is used for the following image formation cycle. In other words, the peripheral surface of the photosensitive drum 51 is repeatedly used for image formation.

(2) Fixing Apparatus 56

1) General Structure

Regarding the directions of the structural components, parts, etc., of the fixing apparatus in the following description of the fixing apparatus in this embodiment, the lengthwise direction means the direction perpendicular to the direction in which the recording medium P is conveyed through the recording medium conveyance passage of the fixing apparatus, whereas the width, or widthwise direction, means the direction parallel to the above described recording medium conveyance direction. The front side of the fixing apparatus means the side from which the recording medium P is fed into the fixing apparatus, and the rear side of the fixing apparatus means the opposite side from the front side (side from which recording medium P comes out of fixing apparatus). The left and right sides of the fixing apparatus means the left and right sides of the fixing apparatus as seen from the front side of the fixing apparatus. The upstream and downstream sides of the fixing apparatus means the upstream and downstream sides in terms of the recording medium conveyance direction.

Figure 1:
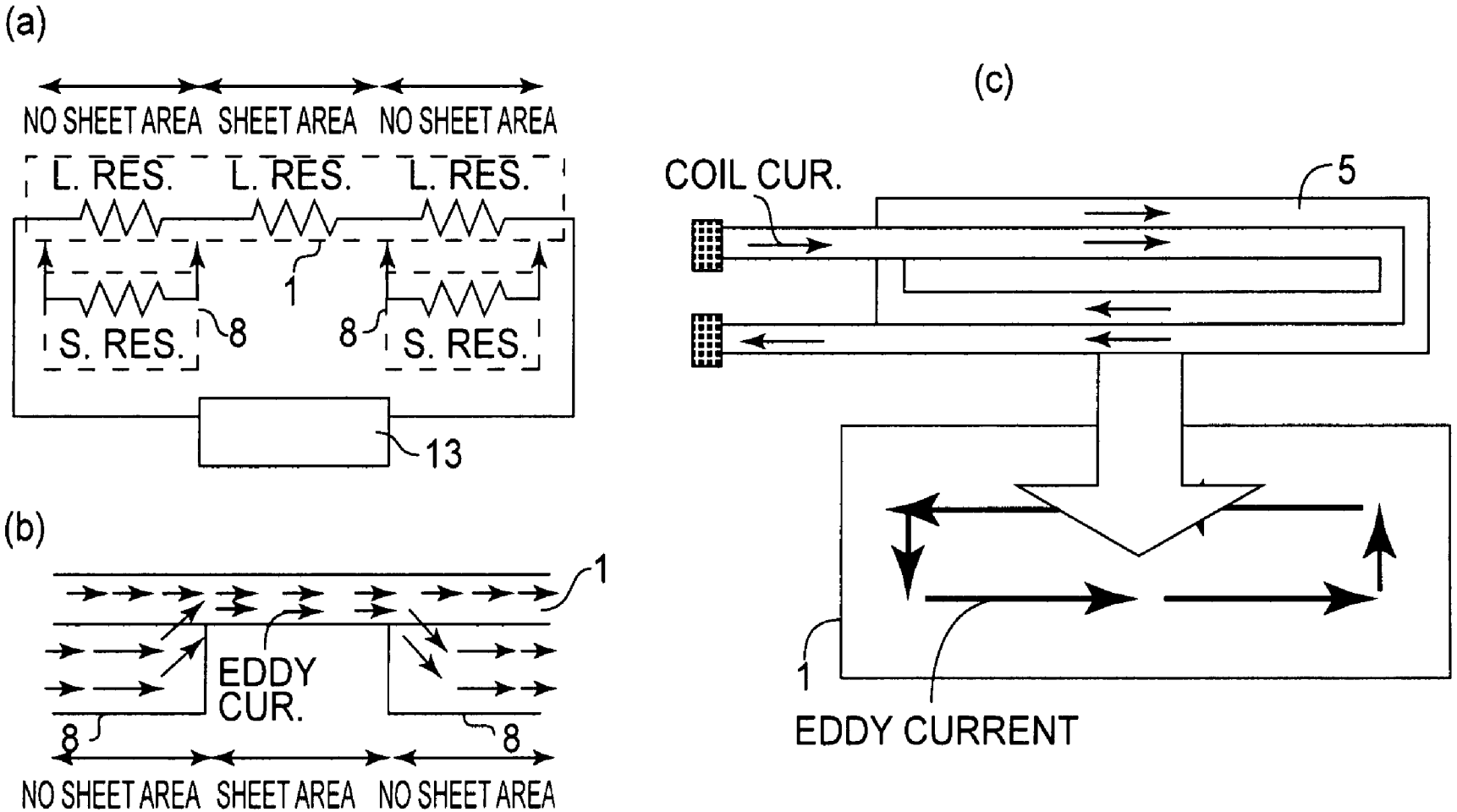
FIG. 1 is a diagrammatic drawing showing the concept on which the fixing apparatuses in the first to seventh embodiments of the present invention are based.
Figure 3:
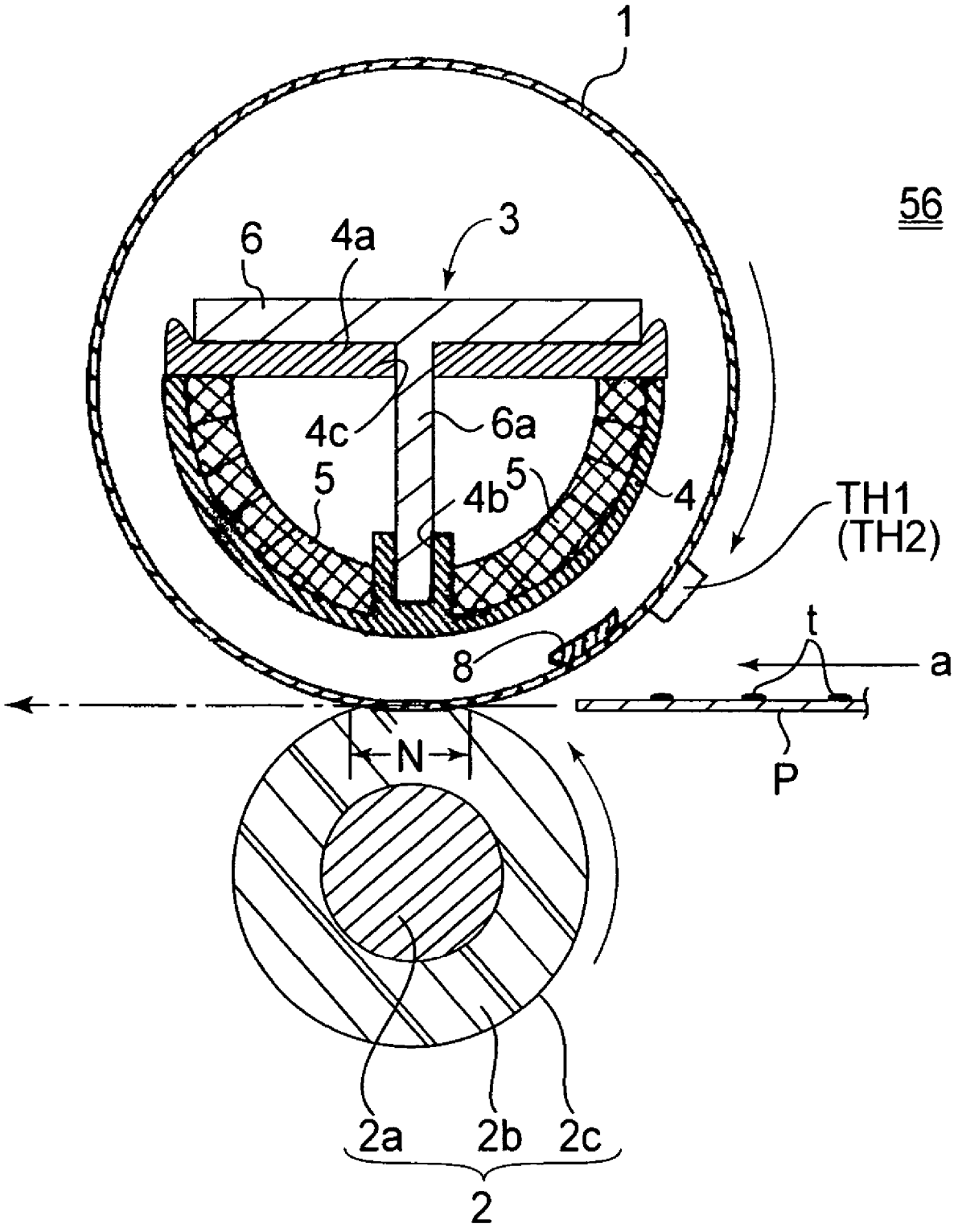
FIG. 3 is an enlarged schematic sectional view of the essential portions of the fixing apparatus in the first embodiment.
Figure 4:
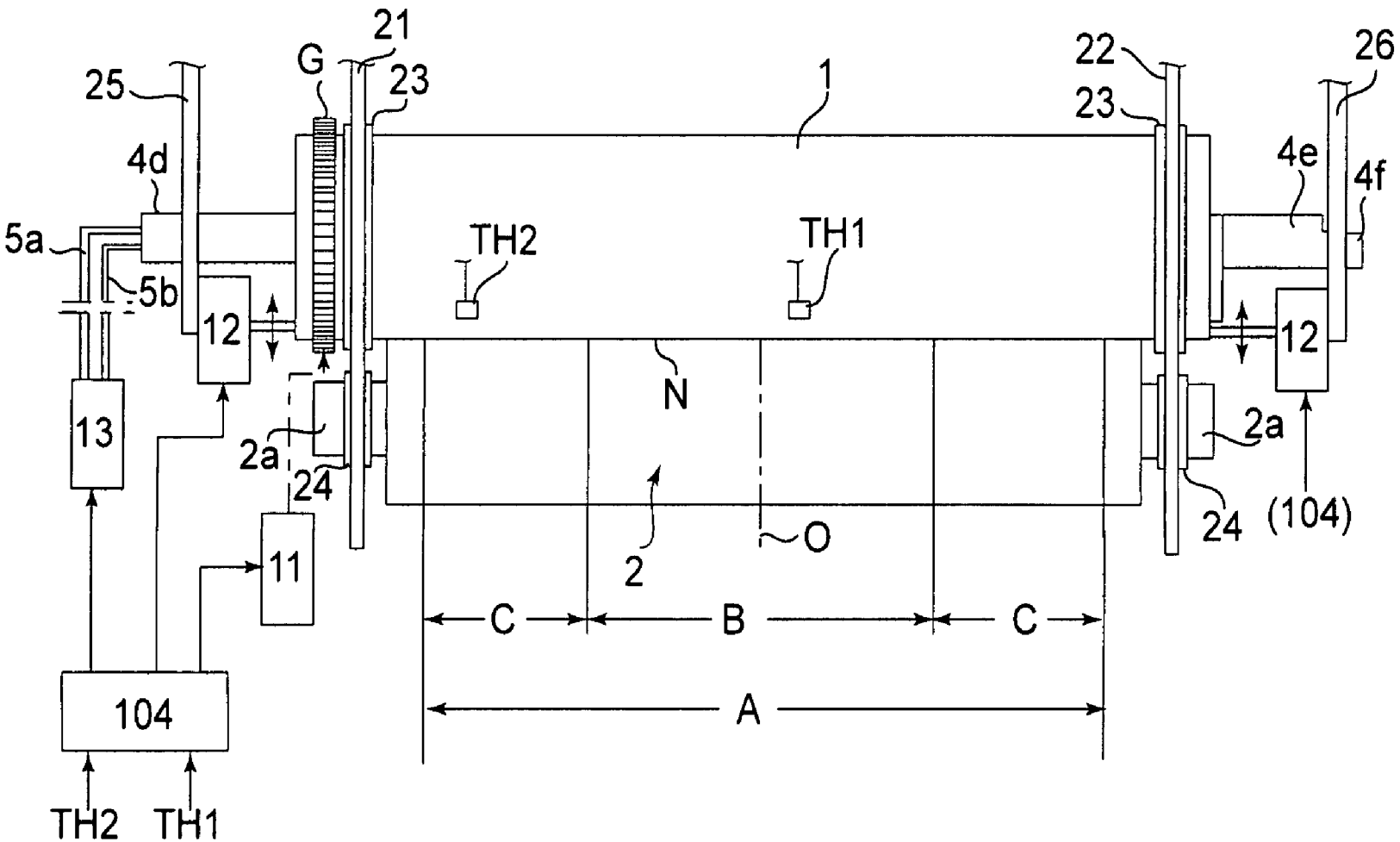
FIG. 4 is a schematic front view of the fixing apparatus in the first embodiment.
Figure 5:
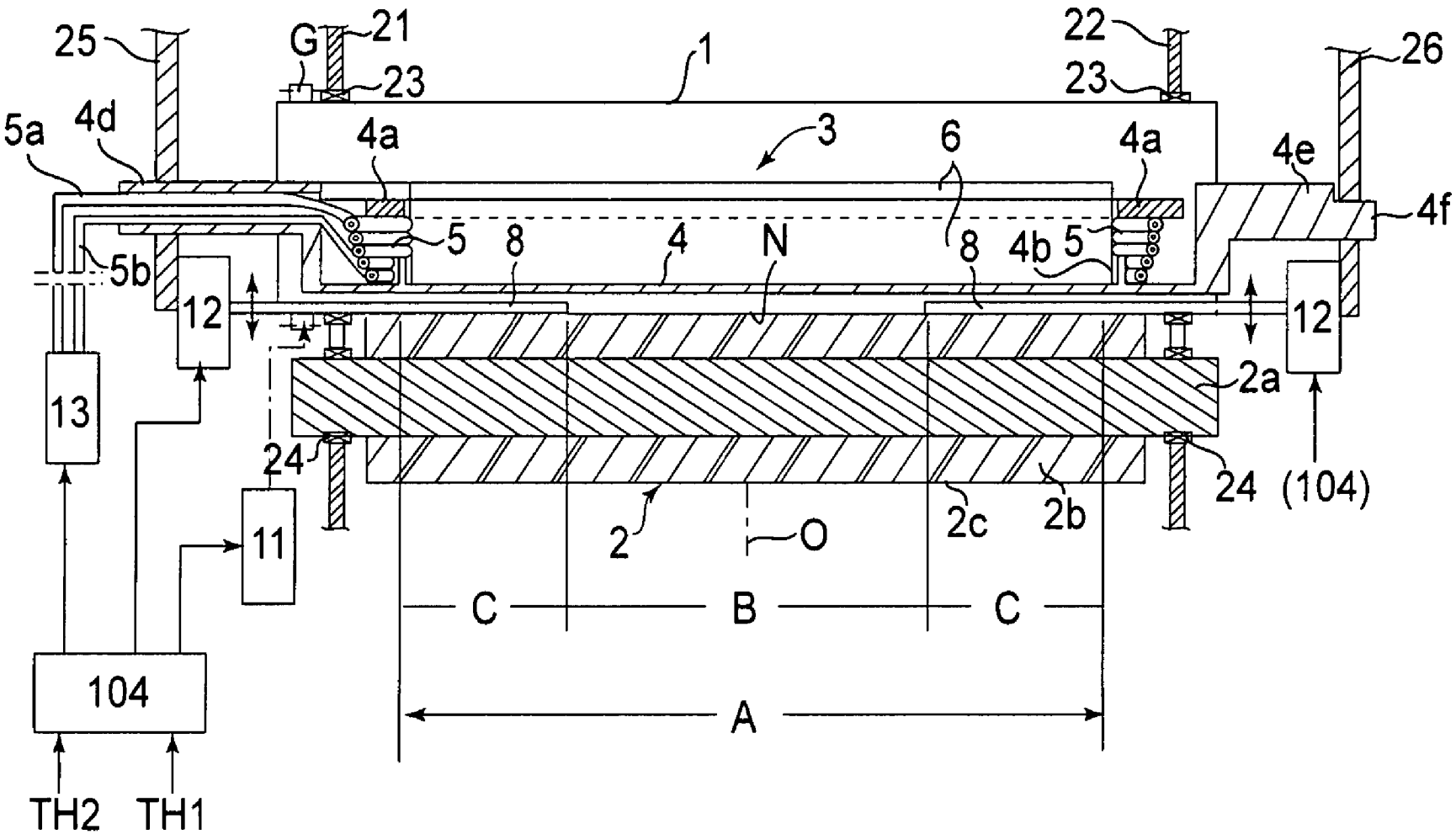
FIG. 5 is a schematic vertical sectional view of the fixing apparatus in the first embodiment, at a plane coinciding with the axial line of the fixation roller.

FIG. 1 is a diagrammatic drawing depicting the concept of the fixing apparatus, which is common to the first to seventh embodiments of the present invention. FIG. 3 is an enlarged schematic sectional view of the essential portions of the fixing apparatus in this embodiment. FIG. 4 is a schematic front view of the same essential portions of the fixing apparatus as those shown in FIG. 3. FIG. 5 is a schematic vertical sectional view of the same essential portions of the fixing apparatus as those shown in FIG. 3, at the vertical plane coinciding with the axial line of the fixation roller.

This fixing apparatus 56 is a heating apparatus which employs an inductive heating method and a heat roller. Designated by a referential symbol 1 is a fixation roller as a heat generating member (which hereinafter may be referred to as inductive heat generating member, or simply as image heating member), and designated by a referential symbol 2 is an elastic roller as a pressure applying member. The two rollers 1 and 2 are vertically stacked in parallel, and are kept pressed upon each other by the application of a preset amount of pressure, forming a fixation nip N as a heating station.

The fixation roller 1 is made up of a cylindrical thin metallic roller, and an elastic layer covering the peripheral surface of the metallic roller. The cylindrical thin metallic roller is formed of such a substance as Ni, Fe, SUS, or the like (magnetic metal or the like substance) in which heat can be generated by electromagnetic induction. The thickness of its wall is in the range of 0.02 mm-3.0 mm. The elastic layer is formed of heat resistant fluorinated resin or the like coated on the peripheral surface of the metallic roller. It functions as a release layer. Referring to FIGS. 4 and 5, this fixation roller 1 is rotatably supported at both of its lengthwise ends, by the left and right lateral plates 21 and 22 of the fixing apparatus 1, with a pair of bearings 23 disposed between the lengthwise ends of the fixation roller 1 and left and right lateral plates 21 and 22, one for one.

In the hollow of the fixation roller 1, an excitation coil unit 3 is non-rotationally and rigidly disposed; it is inserted into the hollow of the fixation roller 1. The excitation coil unit 3 is a magnetic flux generating means for generating a high frequency magnetic field to generate Joule heat in the wall of the fixation roller 1 by inducing electric current (eddy current) in the wall.

The pressure roller 2 is made up of a metallic core 2*a*, a heat resistant rubber layer 2*b* formed around the peripheral surface of the metallic core 2*a*, and a heat resistant release layer 2*c* formed of fluorinated resin of the like, around the peripheral surface of the heat resistant rubber layer 2*b*. The pressure roller 2 is rotatably supported at both of the lengthwise ends of the metallic core 2*a*, by the abovementioned left and right lateral plates 21 and 22, with a pair of bearings 24 disposed between the lengthwise ends of the metallic core 2*a* and the lateral plates 21 and 22, one for one. Further, the pressure roller 2 is kept pressed upon the downwardly facing portion of the peripheral surface of the fixation roller 1 by an unshown pressing means, which applies a preset amount of pressure against the elasticity of the heat resistant elastic layer 2*b* so that the fixation nip N is formed.

Designated by a referential symbol G is a gear for driving the fixation roller 1, which is rigidly fitted around the left end of the fixation roller 1. The force for driving the fixation roller 1 is transmitted to the fixation roller 1 through a fixation roller driving mechanism inclusive of this gear G, so that the fixation roller 1 is rotationally driven in the clockwise direction of FIG. 3, at a preset peripheral velocity. As the fixation roller 1 is rotationally driven, the torque is transmitted from the fixation roller 1 to the pressure roller 2 through the friction which is present between the fixation roller 1 and pressure roller 2 in the fixation nip N, causing the pressure roller 2 to follow the rotation of the fixation roller 1. The fixation roller driving mechanism 11 is sequentially controlled by a control portion (CPU) 104.

Figure 6:
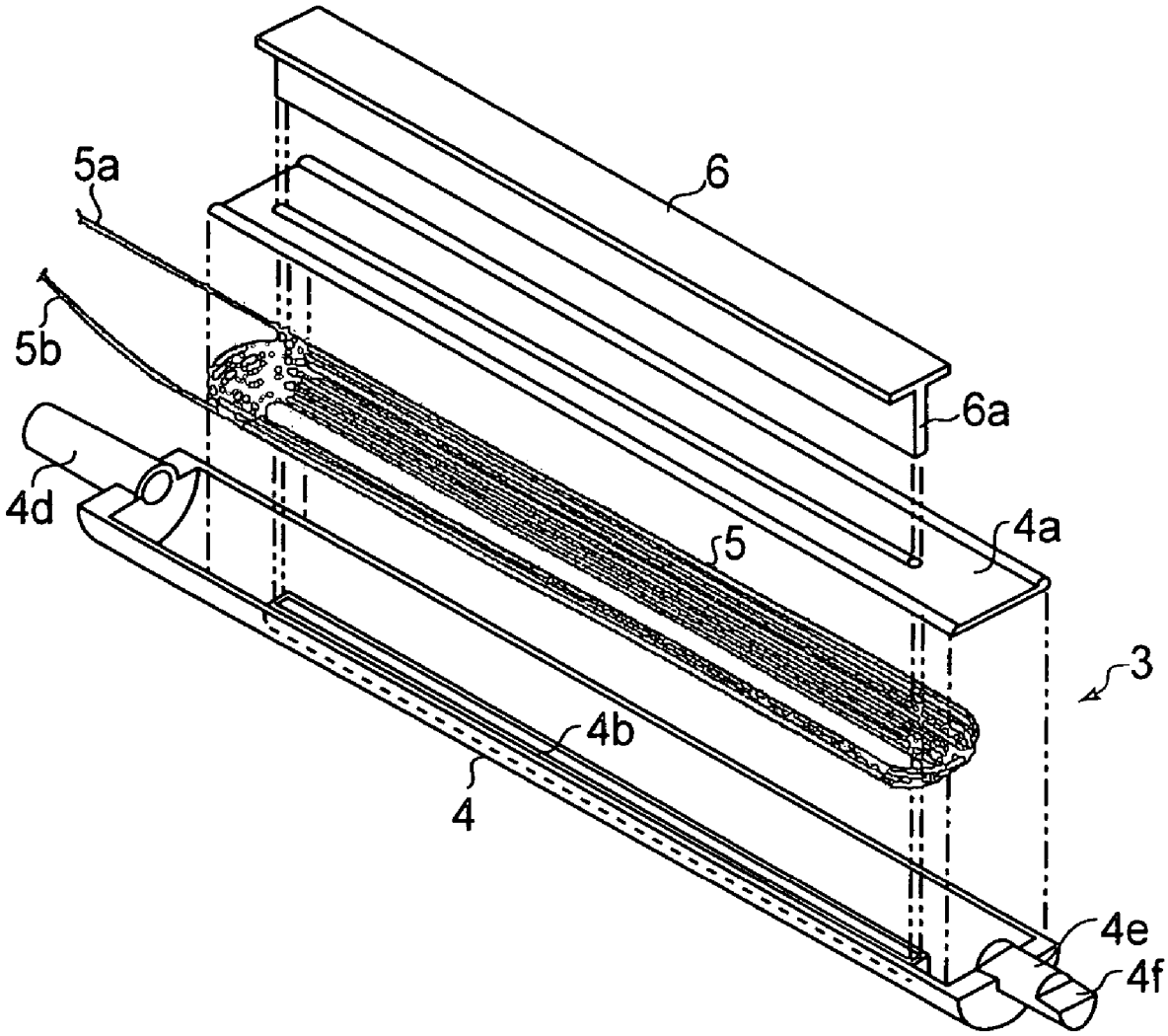
FIG. 6 is an exploded perspective view of the excitation coil unit.

The excitation coil unit 3 is an assembly made up of a holder 4, an excitation coil 5, a magnetic core 6, a cover plate 4*a*, etc. The holder 4 is in the form of a trough which is roughly semicircular in cross section. The external diameter of holder 4 is smaller than the internal diameter of the fixation roller 1. The excitation coil 5 is disposed within the hollow of the holder 4. The magnetic core 6 has a T-shaped cross section. FIG. 6 is a schematic exploded perspective view of this excitation coil unit 3.

The holder 4 and cover plate 4*a* are molded nonmagnetic members which are heat resistant and provided with a reasonable amount of mechanical strength. They are molded of heat resistant and electrically nonconductive engineering plastic, or the like, for example.

The excitation coil 5 must be capable of generating such an alternating magnetic flux that is strong enough in magnitude to generate heat by the amount sufficient for the image fixation. In order to achieve this objective, the excitation coil 5 needs to be low in electrical resistance and high in inductance. As the core wire of the excitation coil 5, a piece of Litz wire, that is, a preset number of bundled pieces of fine wire with a preset diameter, is employed. As the fine wire for the Litz wire, fine electric wire coated with dielectric substance is employed. The Litz wire is wound multiple times around the center portion 6*a* of the magnetic core 6 so that the contour of the resultant excitation coil 5 conforms to the internal surface of the holder 4, and also, so that the resultant excitation coil 5 has the shape of a long and narrow boat, the lengthwise direction of which is parallel to the lengthwise direction of the fixation roller 1. The positional relationship between the center portion 6*a* of the magnetic core 6 and the excitation coil 5 is such that the center portion 6*a* is located in the center of the excitation coil 5.

Designated by a referential symbol 4*b* is a groove of the cover plate 4*a*, into which the bottom portion of the center portion 6*a* of the magnetic core 6 is inserted to support the magnetic core 6. The magnetic core supporting groove 4*b* is located roughly at the center of the inward surface of the cover plate 4*a*, in terms of the width direction of the cover plate 4*a*, and extends from one widthwise end of cover plate 4*a* to the other.

As the material for the magnetic core 6, such a substance as ferrite, Permalloy, Sendust, amorphous silicon steel plate, or the like, which is large in permeability while being small in internal loss, is suitable. The holder 4 and cover plate 4*a* also function as an insulating member for insulating the magnetic core 6 and excitation coil 5 from each other.

The holder 4 is provided with a cylindrical hollow shaft portion 4*d*, which constitutes the lengthwise left end portion of the holder 4. The holder 4 is also provided with a solid shaft portion 4*e*, which constitutes the lengthwise right end portion of the holder 4. The solid shaft portion 4*e* is provided with a D-cut portion 4*f*, which constitutes the lengthwise rightmost end portion of the holder 4. Referring to FIGS. 4 and 5, the excitation coil unit 3 is supported by the left and right auxiliary lateral plates 25 and 26 of the fixing apparatus, with the cylindrical shaft portion 4*d* inserted in the circular hole cut through the left auxiliary lateral plate 25, and the D-cut portion 4*f* of the solid shaft portion 4*e* inserted in the D-shaped hole cut through the right auxiliary lateral plate 26. Thus, the excitation coil unit 3 is non-rotationally supported between the left and right auxiliary lateral plates 25 and 26, in such an attitude that the curved side of the excitation unit 3 faces downward. Further, referring to FIG. 3, the excitation coil unit 3 is disposed in the hollow of the fixation roller 1 so that a preset amount of gap is provided between the internal surface of the fixation roller 1 and the curved side of the excitation coil unit 3. With the excitation coil unit 3 disposed as described above, the axial line of the fixation roller 1, and the axial lines of the cylindrical hollow shaft portion 4*d* and solid shaft portion 4*e* of the holder 4, roughly coincide.

In other words, the excitation coil unit 3 is disposed so that it opposes the internal surface of the fixation roller 1, with such a uniform gap that extends from one lengthwise end of the excitation coil unit 3 to the other, being provided between the outward surface of the curved portion of the semicylindrical excitation coil unit 3 and the corresponding portion of the internal surface of the fixation roller 1, in terms of the circumferential direction of the fixation roller 1.

Through the cylindrical hollow shaft portion 4*d*, a pair of lead wires 5*a* and 5*b* of the excitation coil 5 in the holder 4 are extended outward from within the holder 4, and are connected to a high frequency driver power source (excitation circuit) 13 for supplying the excitation coil 5 with high frequency electric current.

Designated by a referential symbol 8 is an electrically conductive member (current diverting member) as a heat distribution adjusting means, which is placed in contact with, or separated from, the fixation roller 1 to divert the eddy current induced in the wall of the fixation roller 1 in order to adjust the fixation roller 1 in heat distribution, in terms of the lengthwise direction of the fixation roller 1. Hereafter, this electrically conductive member 8 for adjusting the fixation roller 1 in heat distribution will be referred to as eddy current diverting member, or more simply as current diverting member. The eddy current diverting member 8 is placed between the excitation coil unit 3 as the magnetic flux generating means and the fixation roller 1 as the inductive heating member. It is placed in contact with the fixation roller 1, across a specific range of the fixation roller 1, in terms of the lengthwise direction of the fixation roller 1, to establish electrical connection between the current diverting member 8 and the specific range of the fixation roller 1. The eddy current diverting member 8 will be described in detail in the following section (Section 2)).

The high frequency driver power source 13 supplies the excitation coil 5 of the excitation coil unit 3 with high frequency electric current (alternating current) in response to the signals from the control portion 104. The excitation coil 5 uses the high frequency electric current supplied from the driver power source 13, to generate a high frequency magnetic field (alternating magnetic flux) which extends in the lengthwise direction of the fixation roller 1. The alternating magnetic flux is guided by the magnetic core 6, inducing eddy current in the wall of the fixation roller 1. The eddy current interacts with the specific resistance of the fixation roller 1, generating heat (Joule heat) in the wall of the fixation roller 1. In other words, the fixation roller 1 is heated by electromagnetic induction. Since the fixation roller 1 is being rotationally driven, it becomes uniform in surface temperature. More specifically, the high frequency driver power source 13 is driven so that such electric current that is 10 kHz-100 kHz in frequency flows through the excitation coil 5. The eddy current tends to converge to the skin portion of the fixation roller 1, which opposes the excitation coil 5 (this phenomenon is referred as skin effect), increasing the surface portion (skin) of the fixation roller 1 in apparent resistance, enhancing the generation of heat (Joule heat) by the eddy current and the specific resistance of the fixation roller 1.

Figure 7:
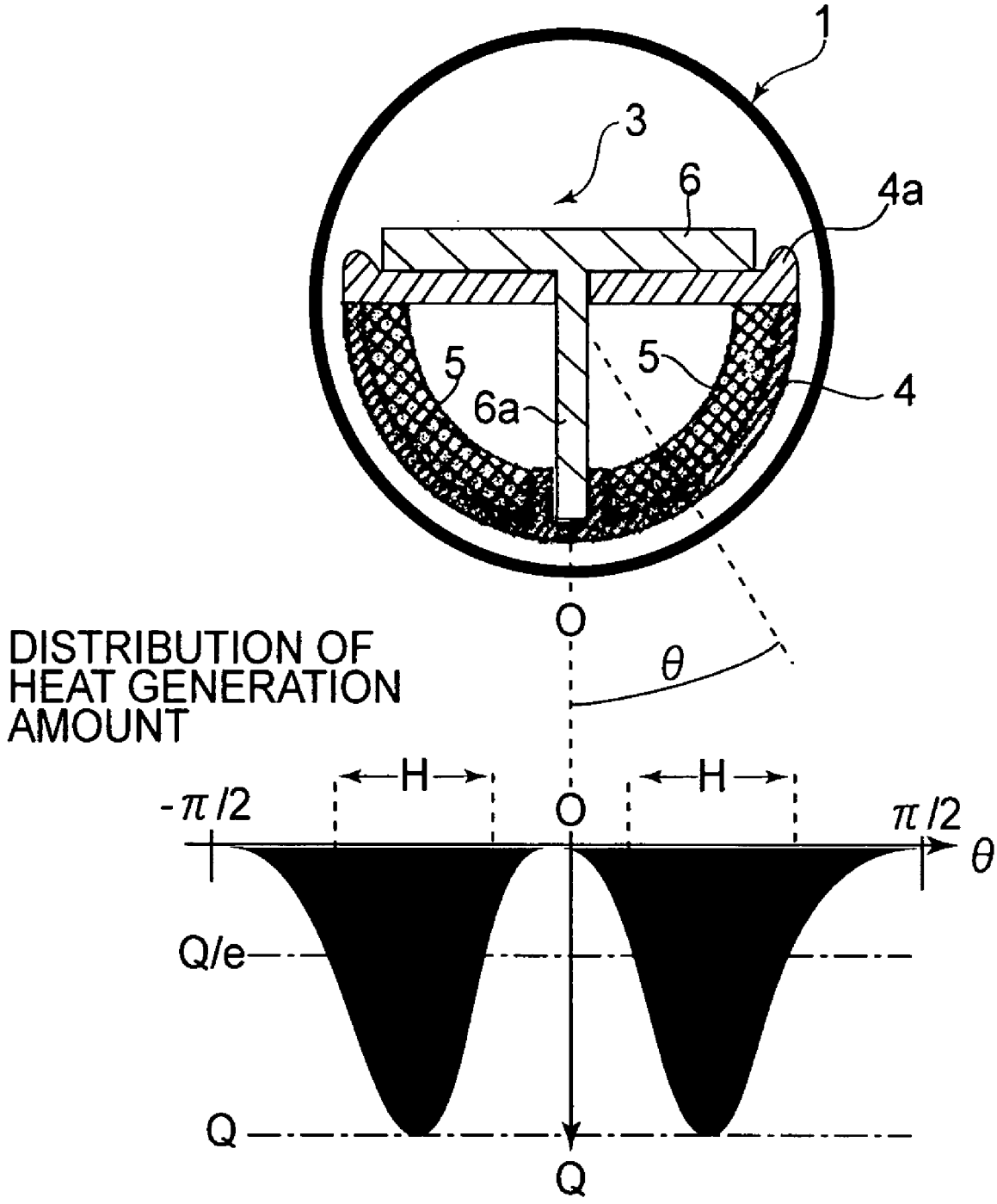
FIG. 7 is the combination of a sectional view of the essential portions of the fixing apparatus, and a graph showing the distribution of the amount by which heat is generated in the fixation roller across the portion of the fixation roller opposing the excitation coil unit.

FIG. 7 is the combination of a schematic sectional view of the fixation roller and a graph of the heat distribution of the fixation roller 1, showing the amount of heat generated in the wall of the fixation roller 1, at a given point in terms of the circumferential direction of the fixation roller 1. The drawing depicts the range in which the magnetic flux extends from the magnetic flux generating means 3 toward and beyond the fixation roller 1, and the corresponding heat distribution of the fixation roller 1 in terms of the circumferential direction of the fixation roller 1. As alternating electric current is flowed through the excitation coil 5 of the excitation coil unit 3 as the magnetic flux generating means, the excitation coil 5 generates alternating magnetic flux. The fixation roller 1 is formed of a magnetic substance, in particular, magnetic metal, as described above. Therefore, electric current (eddy current), which flows in the direction to neutralize the magnetic field, is induced in the wall of the fixation roller 1. The fixation roller 1 is heated by the Joule heat generated by this current induced in the wall of the fixation roller 1, increasing therefore in temperature. In the case of the above described structural arrangement for the fixing apparatus in this embodiment, the outward area of the semicylindrically bulging side of the excitation coil unit 3, more specifically, the area outside the outwardly bulging side of the semicylindrical holder 4 in which the excitation coil 5 and magnetic core 6 are disposed, is the area in which the magnetic flux extending from the excitation coil unit 3 toward and beyond the fixation roller 1 is substantial in magnitude. In other words, the above described area constitutes the magnetic circuit (unshown) which the excitation coil 5, fixation roller 1, and magnetic core 6 establish. The fixation roller 1 is inductively heated in this area in which the magnetic flux is substantial in magnitude. In terms of the circumferential direction of the fixation roller 1, the heat distribution of the fixation roller 1 in terms of the amount by which heat is generated in the fixation roller 1 in the area in which the magnetic flux is significant in magnitude has two areas H and H, that is, areas which are substantial in the amount of heat generated therein, as shown in the schematic drawing (FIG. 7).

Referring to FIG. 4, in the adjacencies of the peripheral surface of the fixation roller 1, first and second temperature detecting means TH1 and TH2 for detecting the temperature of the fixation roller 1 are located. These temperature detecting means TH1 and TH2 are placed in contact, or virtually in contact with, the peripheral surface of the fixation roller 1, being positioned so that they oppose the excitation coil 5 of the excitation coil unit 3, with the presence of the wall of the fixation roller 1 between them and excitation coil 5. Each of them is made up of an ordinary temperature detecting means, for example, a thermistor, a thermopile, a thermocouple, etc. The data regarding the temperature of the fixation roller 1 detected by the temperature detecting means TH1 and TH2 are inputted into the control portion 104. The first temperature detecting means TH1 is for controlling the temperature of the fixation roller 1, and is positioned so that its position roughly coincides with the mid portion of the fixation roller 1 in terms of the lengthwise direction of the fixation roller 1. The control portion 104 controls the high frequency driver power source 13 based on the temperature data inputted into the control portion 104 from the first temperature detecting means TH1. More specifically, the control portion 104 controls the amount by which electric power is supplied to the excitation coil 5 from the high frequency driver power source 13 so that the temperature level of the fixation roller 1 detected by the first temperature detecting means TH1 and inputted into the control portion 104 is maintained at a preset fixation temperature level (target temperature level). The second temperature detecting means TH2 is positioned so that it opposes one of the lengthwise end portions of the fixation roller 1. The temperature data obtained by the second temperature detecting means TH2, that is, the temperature data of one of the lengthwise end portions of the fixation roller 1 (temperature data of portion of fixation roller outside recording paper track), are also inputted into the control portion 104.

While the fixation roller 1 and pressure roller 2 are rotated, the fixation roller 1 is inductively heated by the excitation coil unit 3 as the magnetic flux generating means. As a result, the temperature of the fixation roller 1 reaches the preset fixation temperature level at which the temperature of the fixation roller 1 is maintained. While the temperature of the fixation roller 1 is maintained at the preset fixation temperature level, the recording medium P bearing the unfixed toner image t having just been transferred onto the recording medium P is introduced into the fixation nip N from the direction indicated by an arrow mark a, and then, is conveyed through the fixation nip N while remaining pinched by the fixation roller 1 and pressure roller 2. While the recording medium P is conveyed through the fixation nip N, the heat from the heated fixation roller 1, and the pressure from the pressure roller 2, are applied to the recording medium P and the toner image t thereon. As a result, the unfixed toner image t is fixed to the surface of the recording medium P; a permanent toner image is formed on the recording medium P. After being conveyed through the fixation nip N, the recording medium P is separated from the fixation roller 1, and further conveyed leftward of the drawing.

In the case of the image forming apparatus and fixing apparatus in this embodiment, the recording medium P is conveyed through the apparatuses so that the center of the recording medium P coincides with the center of the recording medium passage of the apparatus in terms of the lengthwise direction of the fixation roller 1. Referring to FIGS. 4 and 5, designated by a referential symbol O is the referential line (hypothetical line), that is, the center line of the recording medium passage (center line of fixing apparatus). Regarding the attributes of the recording medium P, "recording medium width" means the dimension of the recording medium in terms of the direction perpendicular to the recording medium conveyance direction a, provided that the recording medium remains flat. Designated by a referential symbol A is the track of a largest (in terms of "width") recording medium (which hereinafter may be referred to as recording medium of the large size) conveyable through the apparatus (track A hereinafter may be referred to track of recording medium of the large size). Designated by a referential symbol B is the track of a smaller recording medium (which hereinafter may be referred to as recording medium of small size), that is, a recording medium narrower than the recording medium of the large size. The track B hereinafter may be referred to as track of recording medium of the small size. Designated by a referential symbol C is the out-of-track area, that is, the area of the recording medium passage, which will be outside the recording medium track when a recording medium the small size is conveyed through the apparatus (area resulting from difference in width between track of recording medium of large size and track of recording medium of small size. The second temperature detecting means TH2 detects the temperature of the portion of the fixation roller 1, which corresponds in position to the out-of-track area C.

Figure 8:
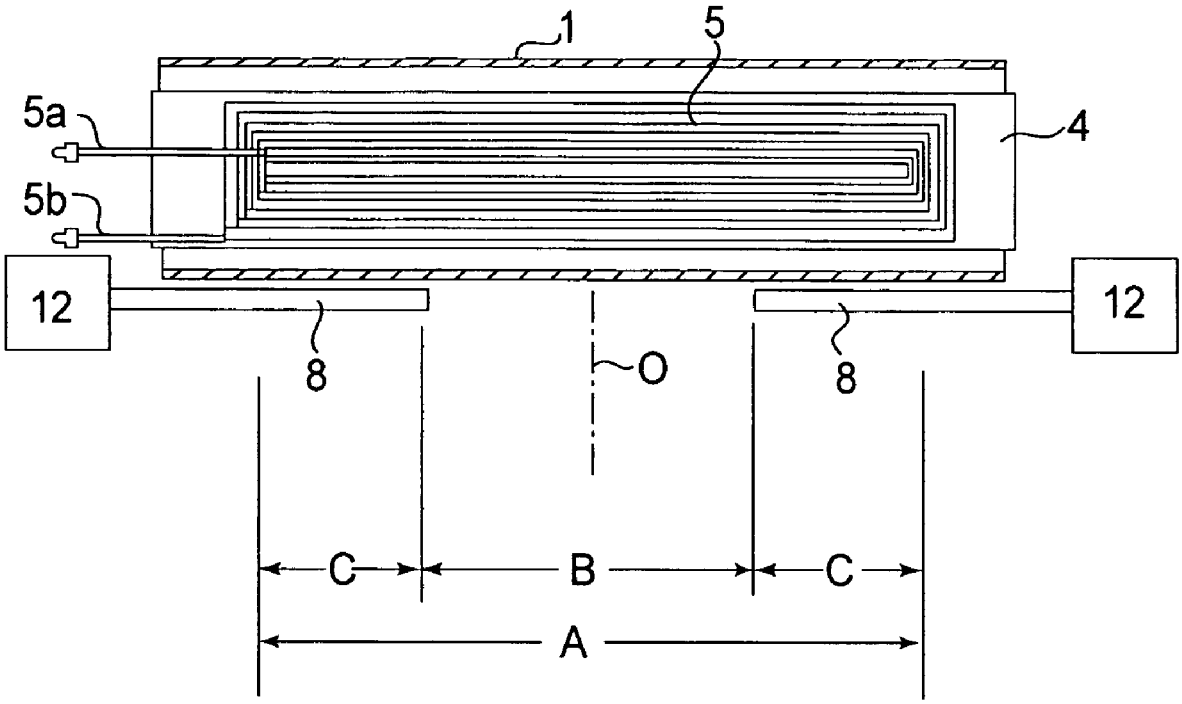
FIG. 8 is a diagrammatic drawing showing the positional relationships among the portion of recording medium passage, which is outside the recording medium track, the portion of recording medium passage, which is within the recording medium track, excitation coil, and members which are placed in contact with, or moved away from, the image heating member to adjust the image heating member in temperature distribution.

FIG. 8 is a diagrammatic drawing showing the positional relationship among the abovementioned recording medium track A, that is, the track of a recording medium of the large size, recording medium track B, that is, the track of a recording medium of the small size, and out-of-track area C, fixation roller 1, excitation coil 5, and eddy current diverting member 8.

2) Eddy Current Diverting Member 8

The eddy current diverting member 8 is a long and narrow electrically conductive member as a heat distribution adjusting means for changing the fixation roller 1 in the distribution of the amount by which heat is generated in the wall of the fixation roller 1, in terms of the lengthwise direction of the fixation roller 1. The fixing apparatus is provided with two eddy current diverting members 8 located so that they overlap with the left and right lengthwise end portions of the fixation roller 1 in terms of the direction perpendicular to the radius direction of the fixation roller 1. There are positioned between the excitation coil unit 3 and the fixation roller 1 as the inductive heating member, extending in the lengthwise direction of the fixation roller 1. The left and right eddy current diverting members 8 are given a length matching the width of the out-of-track area C, and are positioned so that they match in position the out-of-track areas C, one for one.

Designated by a referential symbol 12 is an eddy current diverting member driving means. There are two eddy current diverting member driving means 12, which are attached to the left and right lateral plates 21 and 22, respectively. The left and right eddy current diverting members 8 are supported by the left and right eddy current diverting member driving means 12, respectively, in the cantilever fashion. The left and right eddy current diverting members 8 are the means for changing in position the left and right eddy current diverting members 8, within the gap between the fixation roller 1 and the excitation coil unit 3. Each of the left and right eddy current diverting member driving means 12 is made up of an electromagnetic solenoid-based electromagnetic mechanism, or a cam-based mechanism, for example.

Figure 9:
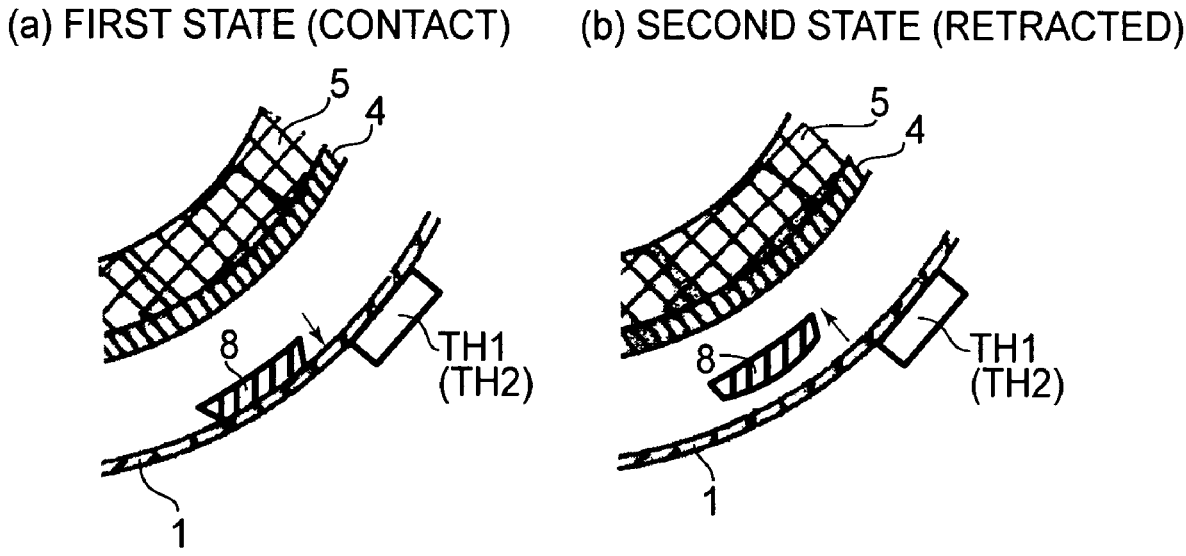
FIG. 9 is a schematic drawing showing the first and second positions for the members which are placed in contact with, or moved away from, the image heating member to adjust the image heating member in temperature distribution.

The control portion 104 controls the left and right eddy current diverting member driving means 12:

to move the left and right eddy current diverting members 8 into a first position in which they remain in contact with the internal surface of the fixation roller 1 as shown in FIG. 9(*a*); or to retract the left and right eddy current diverting members 8 into a second position, shown in FIG. 9(*b*), in which they have no contact with the internal surface of the fixation roller 1.

When the size selection signal S (recording medium size signal from control panel, signal representing recording medium size detected while image is read, print signal, etc.) inputted into the control portion 104 indicates the selection of a recording medium of the large size, the control portion 104 controls the eddy current diverting member driving means 12 so that the left and right eddy current diverting members 8 are moved into, and held in, the second position in which the eddy current diverting members 8 do not contact the internal surface of the fixation roller 1. In this case, the portions of the fixation roller 1, which correspond in position to the track A, that is, the track of a recording medium of the large size, are efficiently and uniformly heated (heat is efficiently and uniformly generated), to the preset fixation temperature level. Therefore, their temperature is controlled so that the temperature level detected by the second temperature detecting means remains at the preset fixation temperature level.

On the other hand, when the size selection signal S having inputted into the control portion 104 indicates the selection of a recording medium of the small size, the control portion 104 controls the eddy current diverting member driving means 12 so that the left and right eddy current diverting members 8 are moved into, and held in, the first position in which the eddy current diverting members 8 remain in contact with the internal surface of the fixation roller 1. Thus, the fixation roller 1 rotates, with the internal surfaces of its left and right lengthwise end portions sliding on the left and right eddy current diverting members 8, respectively. In this case, the portion of the fixation roller 1, which corresponds in position to the track B, that is, the track of a recording medium of the large size, is efficiently and uniformly heated (heat is efficiently and uniformly generated), to the preset fixation temperature level. Therefore, its temperature is controlled so that the temperature level thereof detected by the first temperature detecting means remains at the preset fixation temperature level. In this case, however, the portions of the fixation roller 1, which correspond in position to the out-of-track areas C, are in contact with the electrically conductive eddy current diverting members 8, one for one, by their internal surfaces. In other words, the lengthwise end portions of the fixation roller 1, which correspond in position to the out-of-track areas C, have electrical connection to the eddy current diverting members 8, one for one. Therefore, these portions of the fixation roller 1 are reduced in the efficiency with which heat is generated therein. Consequently, the fixation roller 1 is adjusted in the distribution of the amount by which heat is generated therein, in terms of the lengthwise direction of the fixation roller 1, so that these portions of the fixation roller 1 are minimized in excessive temperature increase.

FIG. 1 is a diagrammatic drawing depicting the concept on which the fixing apparatus in this embodiment is based. In the drawing, the eddy current diverting members 8 are in contact with the fixation roller 1. FIG. 1(*a*) shows the equivalent resistance of the fixation roller 1 in this embodiment. As the eddy current diverting member 8 is placed in contact with a given portion of the fixation roller 1, the portion with which the eddy current diverting member 8 is placed in contact reduces in resistance. FIG. 1(*b*) diagrammatically shows that placing the eddy current diverting member 8 in contact with a given portion of the fixation roller 1 causes the eddy current induced in the wall of the fixation roller 1 to be diverted to the eddy current diverting member 8.

As the eddy current induced in the wall of the fixation roller 1 is partially diverted from a given portion of the fixation roller 1, which is in contact with the eddy current diverting member 8, this portion of the fixation roller 1 is reduced in the amount of the eddy current therein, being therefore reduced in the amount by which heat is generated therein, by the amount equivalent to the amount by which the eddy current is diverted therefrom. In other words, the given portion of the fixation roller 1 can be reduced in the amount of heat generated therein, by partially diverting the eddy current therefrom.

As for the direction in which the eddy current flows, the eddy current is generated so that it flows in the direction to neutralize the magnetic flux generated by the electric current flowed through the excitation coil 5, as shown in FIG. 1(*c*); the eddy current flows in the opposite direction from the direction of the electric current in the excitation coil 5. In reality, therefore, the eddy current diverting member 8 is placed electrically in contact with such a portion of the fixation roller 1 that corresponds in position to the out-of-track area C in terms of the lengthwise direction of the fixation roller 1, and also, that is substantial in the amount by which eddy current is induced in the wall of the fixation roller 1 (portion of fixation roller 1 that opposes excitation coil 5: portion of fixation roller 1 which corresponds to area H, in FIG. 7, which is significant in the amount by which heat in generated in wall of fixation roller 1). Here, "the eddy current diverting member 8 is placed electrically in contact with the fixation roller 1" means that as the eddy current diverting member 8 is placed in contact with the peripheral surface of the fixation roller 1 to allow electric current to flow from the fixation roller 1 to the eddy current diverting member 8.

The density level at which eddy current is induced in the wall of the fixation roller 1 is higher across the portion of the fixation roller 1, which opposes the excitation coil 5. Therefore, placing the eddy current diverting member 8 in contact with this portion of the fixation roller 1 improves the efficiency with which the eddy current in diverted. As for the retraction of the eddy current diverting member 8, it is desired that the eddy current diverting member 8 is retracted into a position in which it is roughly parallel to the magnetic flux generated by the excitation coil 5. Even while the eddy current diverting member 8 is kept retracted, it has a slight effect upon the magnetic flux, and therefore, has a slight effect upon the heat distribution of the fixation roller 1. However, such an effect is extremely small compared to the effect that the eddy current diverting member 8 has while the eddy current diverting member 8 is in contact with the fixation roller 1.

The thicker the eddy current diverting member 8, the more effective to divert the eddy current. In particular, if the eddy current diverting member 8 is thicker than the skin depth of the fixation roller 1, the eddy current diverting member 8 is even more effective to divert the eddy current. As long as the eddy current diverting member 8 is no more than 2 mm in thickness, the effect it has on the magnetic flux while it remains retracted is insignificant. From the standpoint of the mechanical strength of the eddy current diverting member 8, the thickness of the eddy current diverting member 8 is preferred to be no less than 0.05 mm.

The material for the eddy current diverting member 8 has only to be an electrically conductive metal. However, using, as the material for the eddy current diverting member 8, such a metal as Cu, Al, Ag, Au, or the like, which is very high in electrical conductivity, yields the eddy current diverting member 8 which is superior in the eddy current diversion effect. As for the actual movement of the eddy current diverting member 8, when a recording medium of the small size is conveyed, the eddy current diverting member 8 is placed in contact with the portion of the fixation roller 1, which corresponds in position to the out-of-track area C, functioning thereby to divert the eddy current induced in the fixation roller 1 from this portion of the fixation roller 1 to itself to prevent this portion of the fixation roller 1 from excessively increasing in temperature.

Regarding the timing with which the eddy current diverting member 8 is moved into the first position in which the eddy current diverting member 8 remains in contact with the internal surface of the fixation roller 1, it is also possible to move the eddy current diverting member 8 into the first position as the control portion 104 detects that the difference between the temperature level of the fixation roller detected by the first temperature detecting means and the temperature level of the fixation roller detected by the second temperature detecting means has become greater than a preset value (as the temperature of the portion of the fixation roller 1, which corresponds to the out-of-track area C, exceeds a permissible level).

The portion of the eddy current diverting member 8, which is rubbed by the fixation roller 1, is subjected to mechanical stress. Therefore, in order to minimize the effect of the mechanical stress, the eddy current diverting member 8 should be rounded along the edges, and/or should be curved.

In this embodiment, the inductive heating member, that is, the fixing member, is in the form of a roller. However, as far as the present invention is concerned, the shape of the inductive heating member does not matter. For example, the effect of the present invention is the same as the above described one, even if the present invention is applied to an inductive heating member which is in the form of a belt.

Also in this embodiment, both the eddy current diverting member, and the portion of the fixation roller 1 with which the eddy current diverting member 8 is placed in contact, are rendered electrically conductive. However, as long as it is ensured that electrical current is allowed to flow between the eddy current diverting member and fixation roller 1, the fixation roller 1 may be provided with a thin surface layer (electrically nonconductive layer) which is low in friction.

In the case of a magnetic flux blocking plate, it is limited in terms of the position in which it can effectively block the magnetic flux (it has to be placed directly below the center of coil). Thus, when it is unnecessary to block the magnetic flux, it has to be rotated in the direction parallel to the circumferential direction of the fixation roller 1 to be retracted away from the magnetic flux blocking position into the position in which its effect upon the magnetic flux is insignificant (for example, the opposite side of the excitation coil unit from the pressure roller, where its effect upon the magnetic flux is insignificant because of the positioning of magnetic core). This rotational retraction of the magnetic flux blocking plate sometimes creates such problems as that it comes into contact with the fixation roller; it hangs up on the coil holder; and/or the like problems. Further, a magnetic flux blocking plate almost entirely blocks the portion of the magnetic flux which would act on the fixation roller 1, were it not for the magnetic flux blocking plate. Therefore, as soon as a given portion of the fixation roller 1 is shielded from the magnetic flux by the magnetic flux blocking plate, it reduces in temperature very quickly. Further, in order for a magnetic flux blocking plate to block the magnetic flux, its width (in terms of direction parallel to circumferential direction of fixation roller) must be greater than a certain value. In comparison, in the case of the eddy current diverting member 8, simply separating the eddy current diverting member 8 from the designated area of the fixation roller 1 (area corresponding in position to coil) nullifies the current diverting effect of the eddy current diverting member 8. Therefore, the eddy current diverting member 8 is operationally advantageous over a magnetic flux blocking plate in that it is shorter in the distance by which it has to be moved to control the inductive heating member in heat distribution, and also, that it is effective even if it is small in the abovementioned width. In addition, the eddy current diverting member 8 partially diverts the eddy current induced in the wall of the fixation roller 1. Therefore, it does not occur that as soon as the eddy current diverting member 8 is placed in contact with a given area of the fixation roller 1, this area of the fixation roller 1 very quickly reduces in temperature. Therefore, the eddy current diverting member 8 does not need to be driven as frequently as the magnetic flux blocking plate. Moreover, the eddy current diverting member 8 can be used even without the presence of the core. Therefore, it is thought to be superior to a magnetic flux blocking plate in terms of the requirements regarding the position into which they are to be retracted.

Embodiment 2

In this embodiment, the thickness of the inductive heating member of the fixing apparatus is no more than the skin depth of the fixation roller. The inductive heating member is disposed in the gap between the heat distribution adjusting means and magnetic flux generating means. The heat distribution adjusting means is an electrically conductive member, which is to be placed electrically in contact with, or moved away from, the area of the fixation roller 1 next to its lengthwise end.

Figure 10:
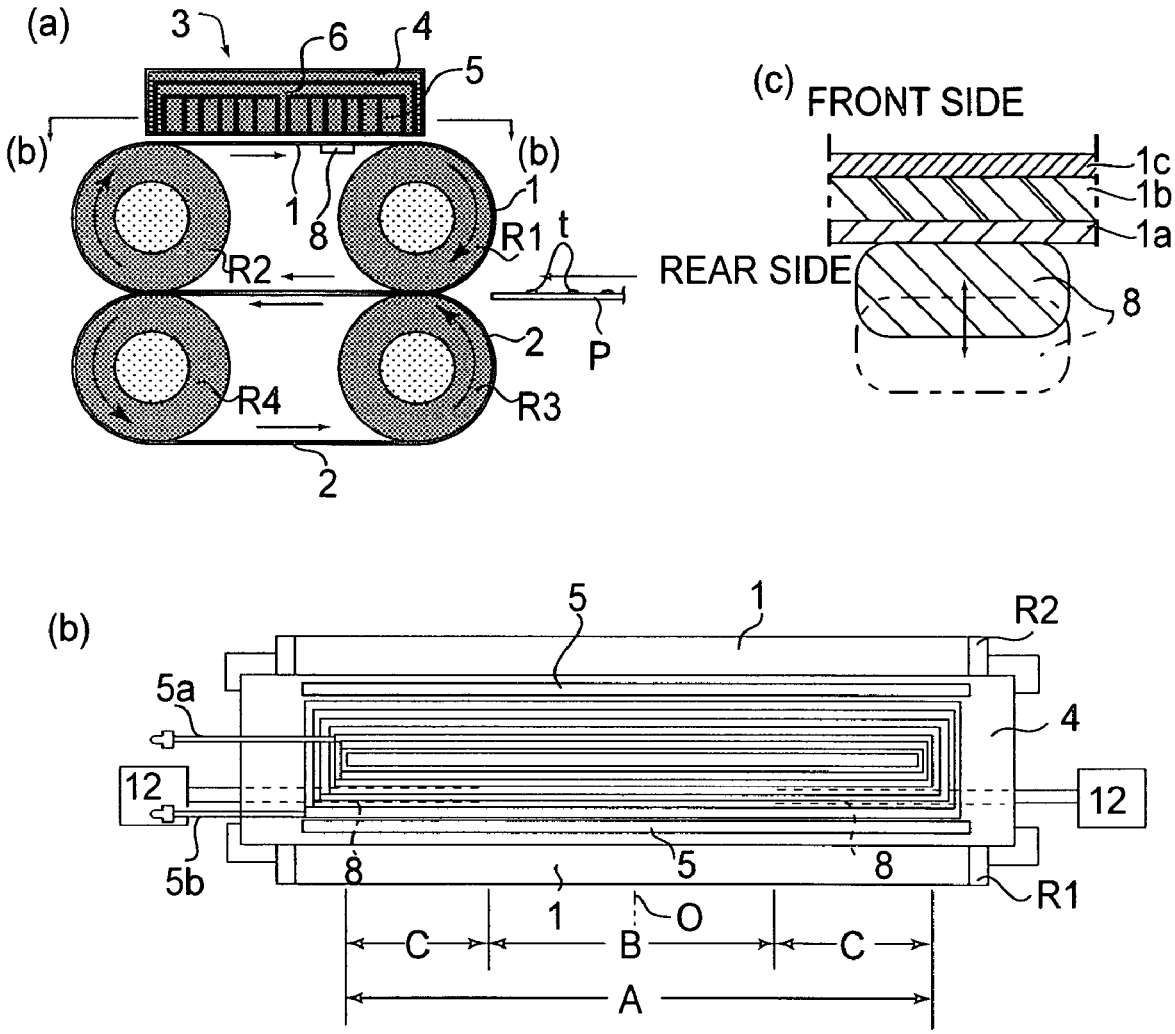
FIG. 10 is a schematic drawing of the fixing apparatus in the second embodiment of the present invention, showing the general structure thereof.

FIG. 10(*a*) is a schematic sectional view of the essential portions of the fixing apparatus in this embodiment, and FIG. 10(*b*) is a schematic sectional plan view of the fixing apparatus, at Line (b)-(b) in FIG. 10(*a*).

In the fixing apparatus in this embodiment, an inductive heating member 1 as a heating member is in the form of a belt (which hereinafter will be referred to as fixation belt). Further, a pressing member 2 is also in the form of a belt (which hereinafter will be referred to as pressure belt). The fixation belt 1 is stretched around, being thereby suspended by, two rollers R1 and R2, which are arranged in parallel. The pressure belt 2 is stretched around, being thereby suspended by, two rollers R3 and R4, which are arranged in parallel. The two belts 1 and 2 are vertically stacked in parallel, and are pressed upon each other by the application of a preset amount of pressure, forming a fixation nip as a heating station. The fixation belt 1 and pressure belt 2 are circularly driven in the direction indicated by an arrow mark to convey a sheet of recording medium through the fixation nip while keeping the recording medium pinched between the two belts 2. Above the fixation belt 1, an excitation coil unit 3 as a magnetic flux generating means is disposed with the provision of a preset amount of gap between the excitation coil unit 3 and the portion of the fixation belt 1, which is closest to the excitation coil unit 3. The excitation coil unit 3 is an assembly made up of an excitation coil 5, a magnetic core 6, a holder 4 by which the coil 5 and core 6 are held, etc. The excitation coil 5 in this embodiment is flatly wound in the form of a "rectangular" volute, the lengthwise direction which is parallel to the width direction of the fixation belt 1.

FIG. 10(*c*) shows an example of the laminar structure for the fixation belt 1. The fixation belt 1 is made up of a metallic layer 1*a* in which heat is inductively generated, a 100 μm-500 μm thick silicon rubber layer 1*b* as an elastic layer layered on the metallic layer 1*a*, and a release layer 1*c* as a surface layer formed of polyimide or the like. When the recording medium P bearing a toner image t is conveyed through the fixation nip, it is conveyed on the surface layer side of the fixation belt 1. In this embodiment, the thickness of the surface layer formed of dielectric nonmagnetic substance is unimportant.

When the fixation belt 1 is inductively heated, the eddy current concentrates to the portion of the skin of the inductive heating member (metallic layer) 1*a*, which directly opposes the excitation coil unit 3 (excitation coil 5). This phenomenon is called skin effect, which can principally expressed by the following mathematical equation:

$$\text{skin depth } \delta=(2\rho/\omega\mu)^{1/2} \quad (m)$$

ρ: resistivity

ω: angular frequency

μ: permeability

Given in the following Table 1 are skin depths of ordinary substances.

TABLE 1

| | resistivity Ωcm | μ | at 20 kHz skin depth mm |
|---|---|---|---|
| Steel | 9.8E−08 | 100 | 0.11 |
| SUS430 | 6E−07 | 100 | 0.28 |
| SUS304 | 7.2E−07 | 1 | 3.02 |
| Al | 2.5E−08 | 1 | 0.56 |
| Cu | 1.7E−08 | 1 | 0.46 |
| Ni | 7E−08 | 50 | 0.19 |

Reducing the inductive heating layer 1*a* of the fixation belt 1 in thickness to a value equivalent to the skin depth of the material used for the inductive heating layer 1*a* increases the inductive heating layer 1*a* in apparent resistance. This occurs because the reduction renders the inductive heating layer 1*a* roughly uniform in the eddy current density in terms of its thickness direction.

Figure 11:
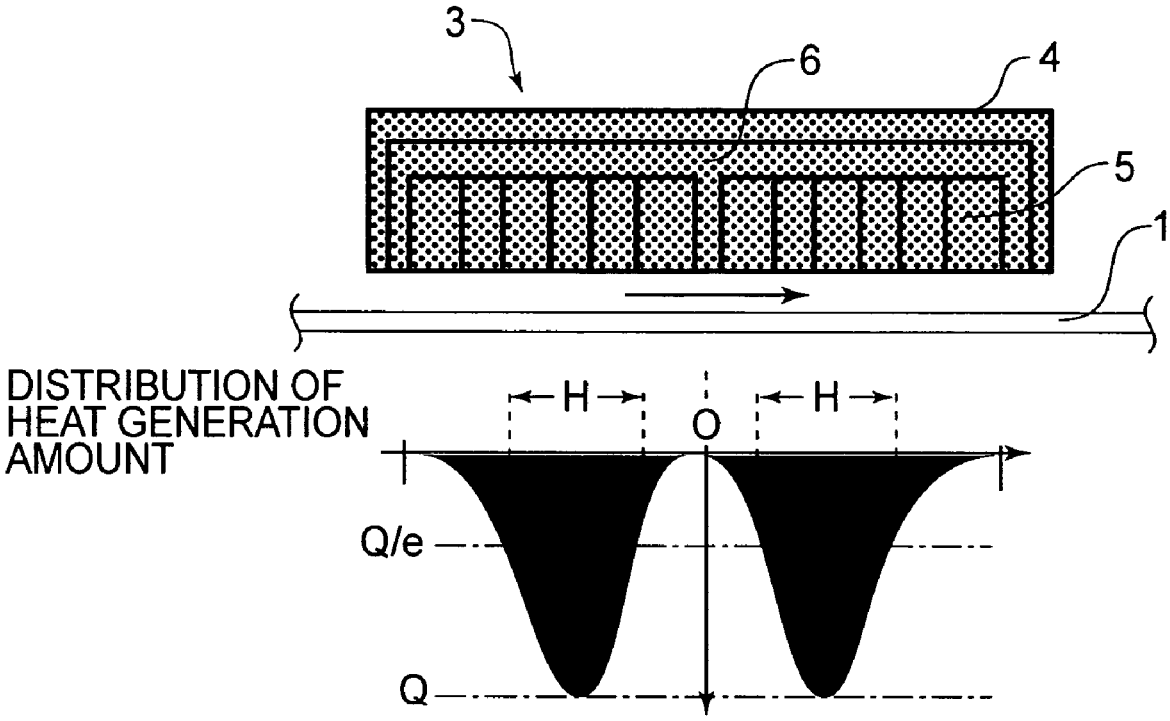
FIG. 11 is a diagrammatic drawing showing the heat distribution of the portion of the fixation belt, which corresponds in position to the excitation coil unit, in terms of the direction parallel to the direction of the belt movement.

In this embodiment, therefore, the thickness of the inductive heating layer 1*a* of the fixation belt 1 is made to be no more than the value equivalent to the skin depth of the material used for the inductive heating layer 1*a*. Further, the eddy current diverting member 8 is disposed so that the fixation belt 1 is sandwiched between the excitation coil 5 and eddy current diverting member 8, with the eddy current diverting member 8 placed directly and electrically in contact with the opposite surface of the fixation belt 1 from the excitation coil 5, that is, the inductive heating layer 1*a* of the fixation belt 1. This structural arrangement was proved to be effective to reduce the amount by which heat is generated, by diverting the eddy current. More specifically, the eddy current diverting member 8 is placed electrically in contact with the area of the fixation belt 1, which corresponds in position to the out-of-track area C, and in which eddy current is induced (roughly opposite area of fixation belt from excitation coil 5). FIG. 11 is a diagrammatic drawing showing the heat distribution of the area of the fixation belt 1 which directly faces the excitation coil unit, in terms of the amount by which heat is generated. As will be evident from FIG. 11, there are two areas H and H where heat is generated by a significant amount. The areas of the fixation belt 1 roughly facing the excitation coil 5 are higher in eddy current density. Therefore, placing the eddy current diverting member 8 in contact with these areas of the fixation belt 1 enhances the eddy current diverting effect of the eddy current diverting member 8.

The material for the eddy current diverting member 8 has only to be an electrically conductive metal. However, using, as the material for the eddy current diverting member 8, such a metal as Cu, Al, Ag, Au, or the like, which is very high in electrical conductivity, yields such an eddy current diverting member 8 that is superior in the eddy current diversion effect.

The thicker the eddy current diverting member 8, the more effective to divert the eddy current. In particular, if the eddy current diverting member 8 is thicker than the skin depth of the fixation belt 1, the eddy current diverting member 8 is even more effective to divert the eddy current.

Therefore, the eddy current induced in the fixation belt 1 is partially diverted from the fixation belt 1 to the eddy current diverting member 8 through the area of the fixation belt 1, which is in contact with the eddy current diverting member 8, reducing thereby the amount by which Joule heat is generated in this area of the fixation belt 1 through the interaction of the resistance of the fixation belt 1 and the eddy current. Consequently, the portion of the fixation belt 1, which corresponds in position to the out-of-track area C, is prevented from excessively increasing in temperature.

The control for moving the eddy current diverting member 8 into the first position from the second position, or moving the second position to the first position is the same as that in the first embodiment.

In the first and second embodiment, the eddy current diverting member 8 is in the form of a piece of flat plate, and is rubbed by the fixation roller 1 and the metallic layers of the fixation belt 1, respectively. Giving a flat shape to the eddy current diverting member 8 increases the eddy current diverting member 8 in the size of the area by which the eddy current diverting member 8 contacts the fixation belt 1, rendering thereby the eddy current diverting member 8 more effective to reduce the fixation belt 1 in temperature. The portion of the eddy current diverting member 8, which the fixation belt 1 first touches (begins to rub) as the eddy current diverting member 8 is placed in contact with the fixation belt 1, is likely to be subjected to mechanical stress. Therefore, in order to prevent this portion of the eddy current diverting member 8 from being subjected to mechanical stress, this portion of the eddy current diverting member 8 should be rounded along the edges, or curved.

Embodiment 3

Figure 12:
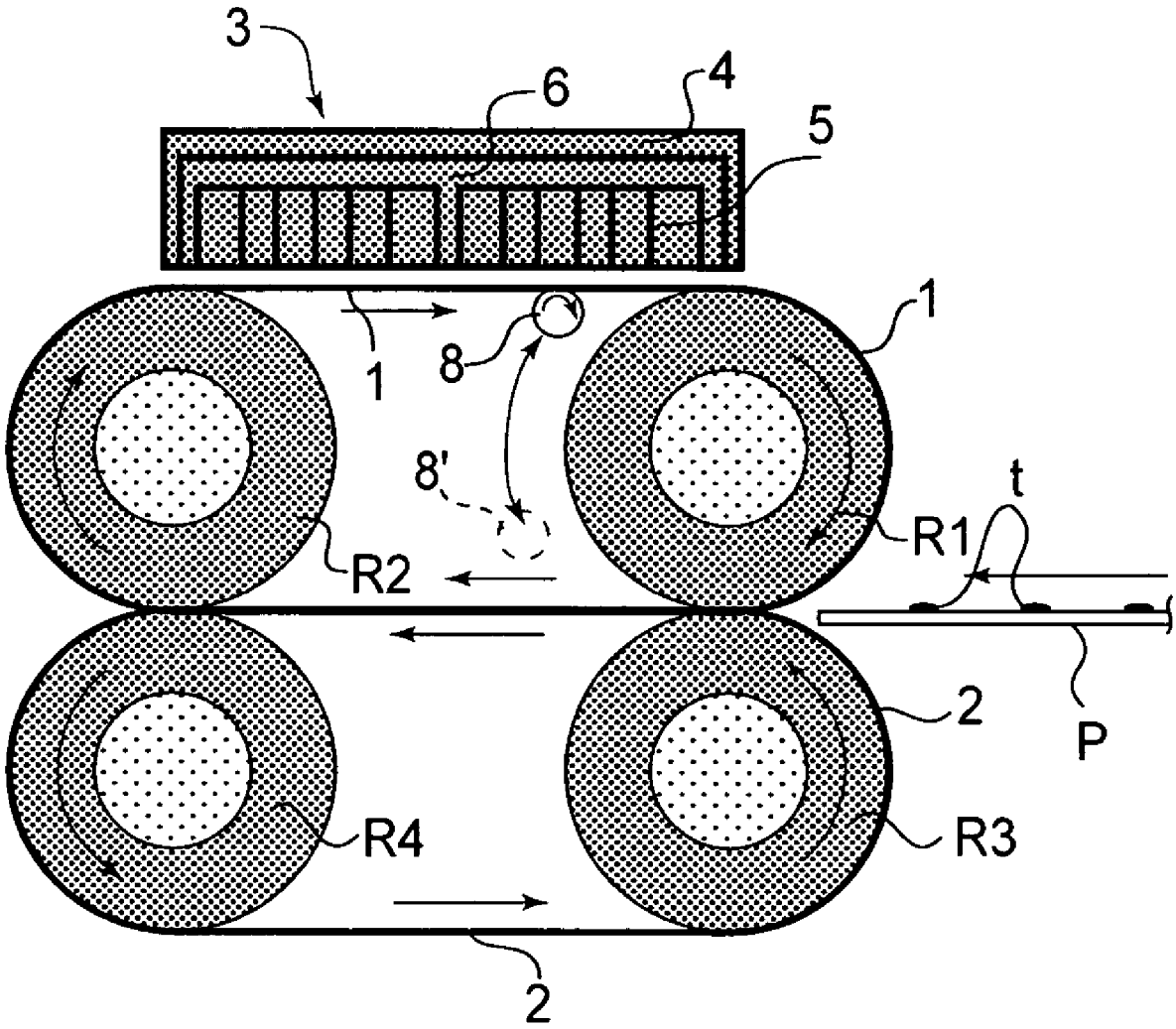
FIG. 12 is a schematic drawing of the fixing apparatus in the third embodiment of the present invention, showing the general structure thereof.

Referring to FIG. 12, in this embodiment, the eddy current diverting member 8 of the fixing apparatus is similar in concept to that in the second embodiment, except that the eddy current diverting member 8 in this embodiment is given the form of a roller. Therefore, while the eddy current diverting member 8 in the form of a roller is kept in contact with the metallic layer 1*a* of the fixation belt 1, it rotates so that the portion of the peripheral surface of the eddy current diverting member 8, which is in contact with the fixation belt 1, moves in the same direction as the moving direction of the fixation belt 1. Giving the eddy current diverting member 8 the form of a roller prevents the eddy current diverting member 8 from being rubbed by the fixation belt 1, making thereby the eddy current diverting member 8 more durable. The fixing apparatus may be structured so that the eddy current diverting member 8 in the form of a roller is rotated by the movement of the fixation belt 1, or the eddy current diverting member 8 is driven independently from the fixation belt 1. However, the arrangement that causes the movement of the fixation belt 1 to rotate the eddy current diverting member 8 is simpler in structure. On the other hand, the arrangement that drives the eddy current diverting member 8 independently from the fixation belt 1 is superior in terms of the ease with which the fixation belt 1 moves.

The eddy current diverting member 8 is provided with a position 8' into which it can be moved to break electrical contact between the eddy current diverting member 8 and fixation belt 1. The recording papers are not uniform in size. Therefore, it is possible that as a recording paper of the small size is conveyed through the fixing apparatus, the portion of the fixation belt 1, which is outside the track of the recording paper of the small size, will excessively increase in temperature. Thus, in order to prevent the occurrence of this phenomenon, the eddy current diverting member 8 is placed electrically in contact with the metallic layer 1*a* of the fixation belt 1 to establish electrical connection between the eddy current diverting member 8 and fixation belt 1, when the recording paper of the small size is conveyed through the fixing apparatus. However, when a recording paper of the large size is conveyed through the fixing apparatus, the eddy current diverting member 8 is moved into the abovementioned position 8' in which the eddy current diverting member 8 has no electrical contact with the fixation belt 1, in order to prevent the fixation belt 1 from reducing in temperature. The eddy current diverting member 8 is disposed within the loop of the fixation belt 1. Thus, the first position (contact position) for the eddy current diverting member 8, in which the eddy current diverting member 8 is enabled to divert the eddy current induced in the fixation belt 1, and the second position (noncontact position) for the eddy current diverting member 8, in which the eddy current diverting member 8 has no electrical connection with the fixation belt 1, are both in the loop of the fixation belt 1.

The control for moving the eddy current diverting member 8 into the first position from the second position, or moving the second position to the first position is the same as that in the first embodiment. That is, the fixing apparatus is structured so that when a recording paper of the large size is conveyed through the fixing apparatus, the eddy current diverting member 8 is retracted into the noncontact position, whereas, when a recording paper of the small size is conveyed through the fixing apparatus, the eddy current diverting member 8 is moved into the contact position, in which the eddy current diverting member 8 remains electrically in contact with the fixation belt 1.

Embodiment 4

Figure 13:
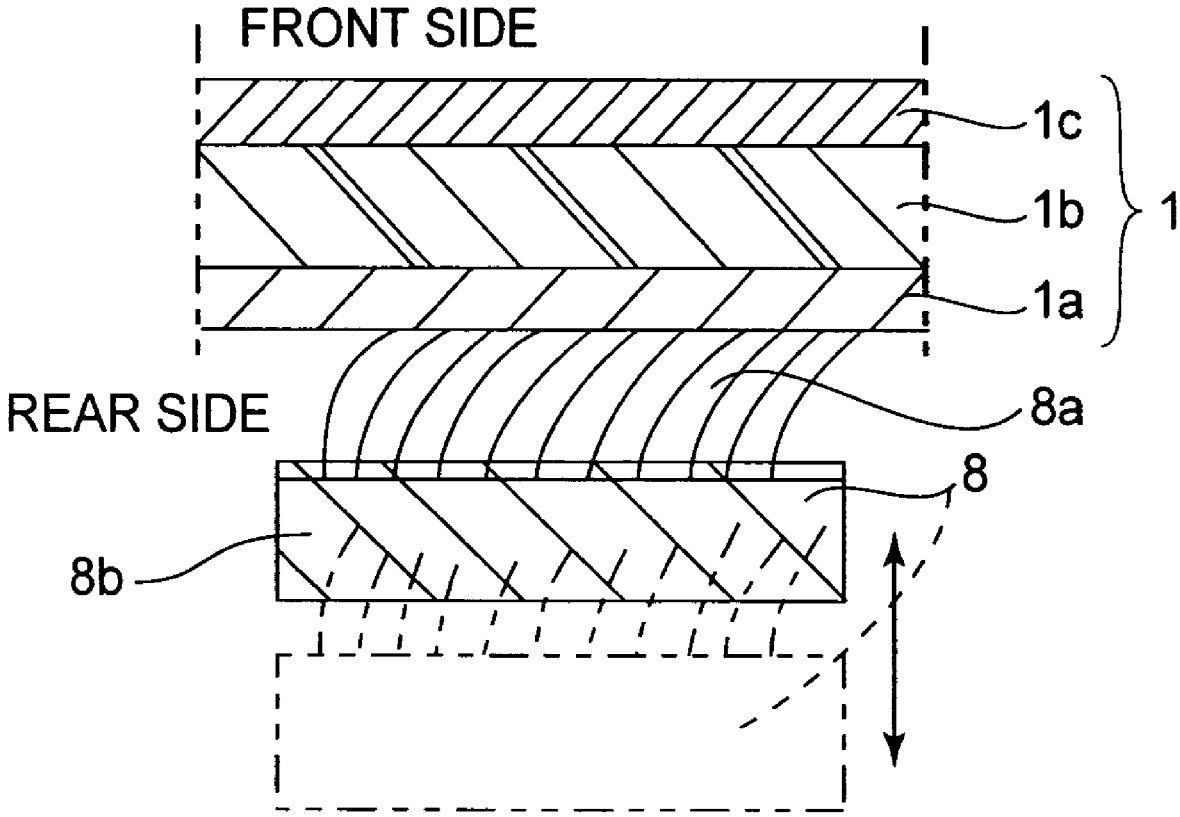
FIG. 13 is a schematic drawing showing the state of contact between the image heating member, and the brush-like member which are placed in contact with, or moved away from, the image heating member to adjust the image heating member in temperature distribution.

Referring to FIG. 13, in this embodiment, the eddy current diverting member 8 of the fixing apparatus is the same in concept, but, it is given the form of a brush. The eddy current diverting member 8 in the form of a brush rubs the metallic layer 1*a* of the fixation belt 1, in terms of relative movement. The actual brush portion 8*a* of the eddy current diverting member 8 is formed of a metal with a high level of electrical conductivity, and the base portion 8*b* of the eddy current diverting member 8 is also formed of a metal with a high level of electrical conductivity. The metal as the material for the actual brush portion 8*a* may be different from that for the base portion 8*b*. Giving the eddy current diverting member 8 the form of a brush can increase in size the total contact area between the eddy current diverting member 8 and fixation belt 1 as an inductive heating member, improving thereby the fixing apparatus in the state of electrical contact between the eddy current diverting member 8 and fixation belt 1.

Embodiment 5

Figure 14:
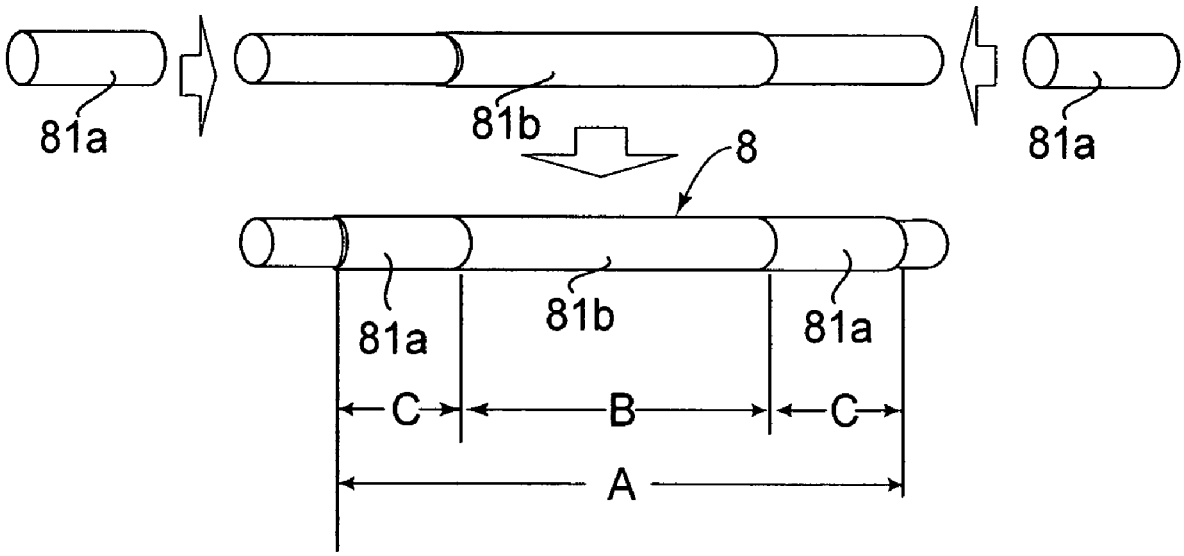
FIG. 14 is a schematic drawing of the cylindrical member, in the fifth embodiment of the present invention, which are placed in contact with, or moved away from, the image heating member to adjust the image heating member in temperature distribution.

Referring to FIG. 14, in this embodiment, the eddy current diverting member 8 is made up of an electrically conductive portion 81*a* and an electrically nonconductive portion 81*b*.

The eddy current diverting member 8 is made up of the electrically conductive portion 81*a* and electrically nonconductive portion 81*b*. The electrically conductive portion 81*a* is formed of an electrically highly conductive metal, whereas the electrically nonconductive portion 81*b* is formed of a resin or ceramic, which is highly dielectric. In the case of a fixing apparatus structured so that when a recording medium is conveyed through the fixing apparatus, the centerline of the recording medium is kept aligned with the centerline of the fixing apparatus, when a recording medium of the small size is conveyed through the fixing apparatus, an area C, which remains outside the track of the recording medium, results on both sides of the track of the recording medium of the small size, in the recording medium passage, in terms of the widthwise direction of the recording medium. In such a case, a pair of the electrically conductive portions 81*a* are disposed so that they correspond in position to the portions of the fixation belt 1, which are next to the lateral edges of the fixation belt 1, one for one. Further, no electrical connection is provided between the two electrically conductive portions 81*a* located near the lateral edges of the fixation belt 1, one for one, being therefore physically separated from each other. The reason for not providing electrical connection between the two electrically conductive portions 81*a* is that if the two electrically conductive portions 81*a* are electrically in connection to each other, the connection affects the two electrically conductive portions 81 in current diverting function, preventing them from providing the fixation belt 1 with a preset temperature distribution, because they are employed to utilize their ability to divert the eddy current. The electrically nonconductive portion 81*b* plays the role of a substrate. As an example of the structure of the eddy current diverting member 8, there is such a structure that the electrically nonconductive portion 81*b* is given the form of a roller, and a pair of the electrically conductive portions 81*a*, which are in the form of a hollow cylinder, are fitted around the portions of the electrically conductive portion 81*b*, which are near the lengthwise ends of the electrically conductive portion 81*b*. The two electrically conductive portions 81*a* fitted around the lengthwise end portions of the electrically nonconductive portion 81*b*, as described above, have no electrical connection to each other. Rendering the electrically nonconductive portion 81*b* the same in diameter as the electrically conductive portions 81*a* prevents the fixation belt 1 from becoming stepped as it comes into contact with the eddy current diverting member 8; it prevents the eddy current diverting member 8 from affecting image quality.

The control for moving the eddy current diverting member 8 into the first position from the second position, or moving the second position to the first position is the same as that in the first embodiment.

In this embodiment, the eddy current diverting member 8 is in the form of a roller. However, the eddy current diverting member 8 may be given the form of a flat board or brush, with the same effects as those described above.

Embodiment 6

In this embodiment, the fixing apparatus is provided with two or more sets of eddy current diverting members 8, which are different in dimension in terms of the direction perpendicular to the direction in which an object to be heated is conveyed.

Figure 15:
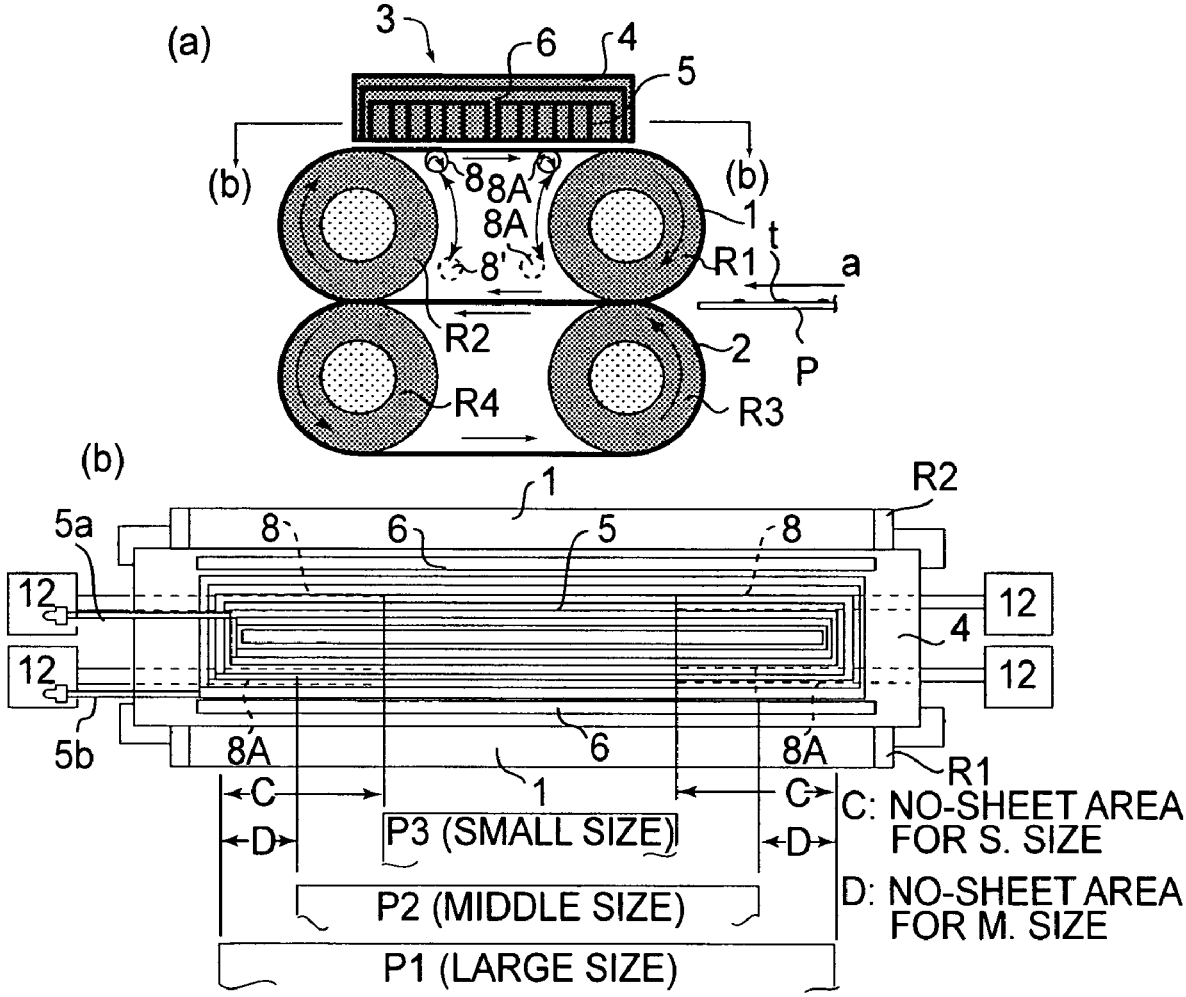
FIG. 15 is a schematic drawing of the fixing apparatus in the sixth embodiment of the present invention, showing the general structure thereof.

FIG. 15(*a*) is a schematic sectional view of the essential portions of the fixing apparatus in this embodiment. FIG. 15(*b*) is a sectional plan view of the fixing apparatus at Line (b)-(b) in FIG. 15(*a*). The fixing apparatus in this embodiment is of the belt type as is the fixing apparatus in the second embodiment.

As high frequency electric current is flowed through the excitation coil 5 of the excitation coil unit 3 from a coil driving electric power source 15, such eddy current that flows in a loop is induced in the portion of the fixation belt 1, which roughly opposes the excitation coil 5. Therefore, the eddy current diverting member 8 is effective to divert the eddy current, no matter where on the portion of the fixation belt 1 in which the eddy current that flows in a loop is induced, the eddy current diverting member 8 is placed in contact. As the fixing apparatus is seen from the recording medium conveyance direction, the fixation belt 1 has two sets of areas with which the eddy current diverting member 8 is to be placed in contact in order to effectively divert the eddy current (FIG. 11). Therefore, providing the fixing apparatus with an additional eddy current diverting member 8A, which is different in lengthwise dimension from the eddy current diverting member 8, per eddy current diverting member 8, as shown in FIG. 15, makes it possible to change the fixation belt 1 in heat distribution according to the size of a recording paper conveyed through the fixing apparatus. For example, in the case of a fixing apparatus enabled to handle three types of recording medium different in size, that is, a paper P1, that is, the largest paper usable with the fixing apparatus, a paper P2, that is, the recording medium of the medium size (second smallest paper) usable with the fixing apparatus, and a paper P3, that is, the recording medium of the small size (smallest paper) usable with the fixing apparatus, two different out-of-track areas C and D, which are different in dimension in terms of the lengthwise direction of the fixing apparatus, are created. Therefore, providing the fixing apparatus with two sets of eddy current diverting members, that is, the eddy current diverting members 8 and eddy current diverting members 8A, which are different in the dimension in terms of the lengthwise direction, makes it possible to prevent the out-of-track areas from excessively increasing in temperature, whether the out-of-track areas are the out-of-track area C or D.

The control for moving the eddy current diverting member 8 into the first position from the second position, or moving the second position to the first position is the same as that in the first embodiment.

Embodiment 7

This embodiment is characterized in that the fixing apparatus is provided with an inductive heating member backing member 1 (fixing belt backing member), which backs the fixing belt 1 as the eddy current diverting member 8 is placed in contact with the inductive heating member 1, because the inductive heating member 1 (fixation belt) is pressed by the eddy current diverting member 8 as the eddy current diverting member 8 is placed in contact with the inductive heating member 1.

Figure 16:
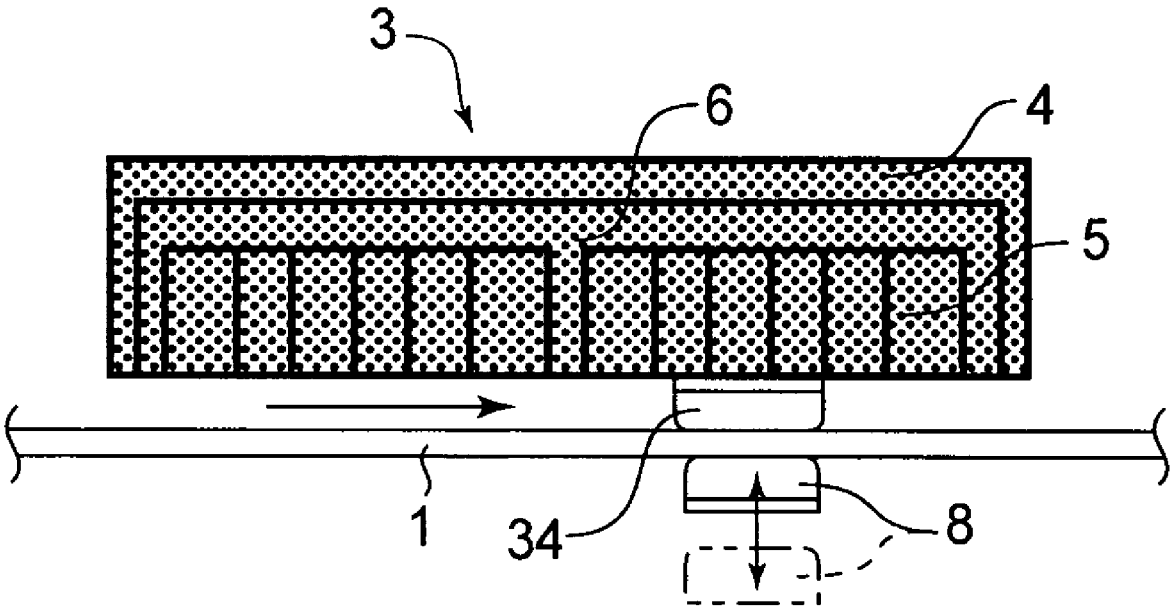
FIG. 16 is a schematic drawing of the essential portions of the fixing apparatus in the sixth embodiment, showing the general structures thereof.

The above described current diverting function of the eddy current diverting member 8 is an electrical function. Therefore, the contact resistance between the metallic layer 1*a* of the fixation belt 1 and the eddy current diverting member 8 is desired to be as small as possible. In this embodiment, therefore, in order to minimize this contact resistance, the fixing apparatus is provided with a belt backing member 34, so that the eddy current diverting member 8 can be pressed against the belt backing member 34, with the fixation belt 1 sandwiched between the eddy current diverting member 8 and belt backing member 34, as shown in FIG. 16, to ensure that the eddy current diverting member 8 remains perfectly in contact with the fixation belt 1.

In order to prevent the belt backing member 34 from affecting the magnetic flux, the belt backing member 34 is desired to be formed of a dielectric substance. Further, the belt backing member 34 comes into contact with the surface of the fixation belt 1, which comes into contact with the image bearing surface of a recording medium. Therefore, it is desired to be formed of such a resin, sponge, rubber, or the like, that is not likely to scar the fixation belt 1.

Further, the belt backing member 34 may be integrated with the excitation coil unit 3, because integrating the belt backing member 34 with the excitation coil unit 3 ensures that the eddy current diverting member 8 remains in contact with the fixation belt 1, and also, eliminates the problematic possibility that the relationship, in terms of the magnetic flux strength, between the excitation coil unit 3 and fixation belt 1 will become unstable due to the changes in the distance between the excitation coil unit 3 and fixation belt 1.

[Miscellanies]

1) In the embodiments described above, the recording medium P is conveyed through the fixing apparatus so that the centerline of the recording medium P coincides with the centerline of the fixing apparatus. However, the present invention is also applicable to a fixing apparatus structured so that when the recording medium P is conveyed through the apparatus, one of the lateral edges of the recording medium P coincides with the referential line of the apparatus. The effects obtained by such an application are the same as those described above.

2) The application of the present invention is not limited to an image heating apparatus, such as the image heating apparatuses in the above described preferred embodiments of the present invention, that employs a heating method based on electromagnetic induction. For example, the present invention is also very effectively applicable to such an image heating apparatus as a fixing apparatus for temporarily fixing an unfixed image to a recording medium, a surface property improving apparatus for improving an image in surface properties such as glossiness by reheating a recording medium bearing a fixed image, and the like apparatuses.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 133237/2005 filed Apr. 28, 2005 which is hereby incorporated by reference.

What is claimed is:

1. An image heating apparatus comprising:

magnetic flux generating means for generating a magnetic flux;

an image heating member, including an electroconductive layer for generating heat by the magnetic flux generated by said magnetic flux generating means, for heating an image on a recording material;

an electroconductive contact member contacting an end of said image heating member in a direction perpendicular to a feeding direction of the recording material, wherein when said contact member is contacting said image heating member, an electrically conductive connection is established between said electroconductive layer and said contact member; and driving means for contacting and separating said contact member and said image heating member.

2. An apparatus according to claim 1, wherein said electroconductive layer has a thickness not more than a skin depth of said electroconductive layer, and said contact member contacts said image heating member at a side across said image heating member from said magnetic flux generating means.

3. An apparatus according to claim 2, wherein said image heating member is in the form of a belt member that is extended around a plurality of supporting members with a predetermined tension, and wherein said magnetic flux generating means is disposed opposed to said belt member in a region between parts of said belt member that are extended around the supporting members.

4. An apparatus according to claim 1, wherein when a recording material of a predetermined size is fed, said contact member contacts a region of said image heating member corresponding to a non-passage region where the recording material of the predetermined size does not pass.

5. An apparatus according to claim 1, wherein said contact member contacts a region of said image heating member corresponding to a non-passage region where a recording material of the predetermined size does not pass when a temperature of the non-passage region becomes higher than a predetermined level.

6. An apparatus according to claim 1, wherein said contact member includes a plate-like member.

7. An apparatus according to claim 1, wherein said contact member includes a roller-like member, and rotates with said image heating member.

8. An apparatus according to claim 1, wherein said contact member includes a brush-like member.

9. An apparatus according to claim 1, wherein said contact member has opposite ends which are supported, and has an electroconductive portion and a non-electroconductive portion at positions corresponding to a region where a recording material of a predetermined size passes and a region where the recording material of the predetermined size does not pass, respectively.

10. An apparatus according to claim 1, wherein said contact member has a plurality of electroconductive portions having different lengths such that a width in which it electrically contacts said image heating member can be different in a widthwise direction perpendicular to a recording material feeding direction.

11. An apparatus according to claim 1, further comprising an urging member for urging said image heating member at a side thereof across said image heating member from said contact member when said contact member contacts said image heating member.

12. An apparatus according to claim 1, wherein said contact member has an electrical conductivity that is higher than an electrical conductivity of said electroconductive layer.

* * * * *